US006761667B1

(12) United States Patent
Cutler et al.

(10) Patent No.: US 6,761,667 B1
(45) Date of Patent: Jul. 13, 2004

(54) HIKING EXERCISE APPARATUS

(75) Inventors: Gordon L. Cutler, Providence, UT (US); Scott R. Watterson, Logan, UT (US); William T. Dalebout, Logan, UT (US); Rodney L. Hammer, Lewiston, UT (US); Kurt Finlayson, Wellsville, UT (US)

(73) Assignee: Icon IP, Inc., Logan, UT (US)

( * ) Notice: Subject to any disclaimer, the term of this patent is extended or adjusted under 35 U.S.C. 154(b) by 0 days.

(21) Appl. No.: 09/496,569

(22) Filed: Feb. 2, 2000

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS

| | | | | |
|---|---|---|---|---|
| 3,592,466 | A | 7/1971 | Parsons | |
| 3,602,502 | A | 8/1971 | Hampl | |
| 4,151,988 | A | 5/1979 | Nabinger | |
| 4,544,152 | A | 10/1985 | Taitel | |
| 4,659,074 | A | 4/1987 | Taitel et al. | |
| 4,687,195 | A | 8/1987 | Potts | |
| 4,759,540 | A | 7/1988 | Yu et al. | |
| 4,848,737 | A | 7/1989 | Ehrenfield | |
| 4,927,136 | A | 5/1990 | Leask | |
| 5,062,632 | A | 11/1991 | Dalebout et al. | |
| 5,088,729 | A | 2/1992 | Dalebout | |
| 5,145,475 | A | 9/1992 | Cares | 482/52 |
| 5,195,935 | A | 3/1993 | Fencel | 482/70 |
| D348,493 | S | 7/1994 | Ashby | D21/192 |
| 5,328,420 | A | 7/1994 | Allen | 482/52 |
| 5,328,422 | A | 7/1994 | Nichols | 482/52 |
| 5,352,166 | A | 10/1994 | Chang | 482/52 |
| 5,382,209 | A | 1/1995 | Pasier et al. | 482/70 |
| 5,512,025 | A | 4/1996 | Dalebout et al. | |
| 5,518,471 | A | 5/1996 | Hettinger et al. | |
| 5,527,245 | A | 6/1996 | Dalebout et al. | 482/54 |
| 5,626,539 | A | 5/1997 | Piaget et al. | 482/54 |
| 5,674,453 | A | 10/1997 | Watterson et al. | |
| 5,733,228 | A | 3/1998 | Stevens | 482/54 |
| 5,743,833 | A | 4/1998 | Watterson et al. | 482/54 |
| 5,810,696 | A | 9/1998 | Webb | 482/52 |
| 5,827,155 | A | 10/1998 | Jensen et al. | |
| 5,833,577 | A | 11/1998 | Hurt | 482/54 |
| 5,860,893 | A | 1/1999 | Watterson et al. | 482/54 |
| 5,860,894 | A | 1/1999 | Dalebout et al. | 482/54 |
| 5,899,834 | A | 5/1999 | Dalebout et al. | 482/54 |
| 6,013,011 | A | 1/2000 | Moore et al. | |
| 6,033,347 | A | 3/2000 | Dalebout et al. | 482/54 |
| 6,045,490 | A | 4/2000 | Shafer et al. | |
| 6,050,921 | A | 4/2000 | Wang | |
| 6,050,923 | A | 4/2000 | Yu | 482/54 |
| 6,068,578 | A | 5/2000 | Wang | |
| 6,110,076 | A | 8/2000 | Hurt | 482/54 |
| 6,132,340 | A | 10/2000 | Wang et al. | |
| 6,174,268 | B1 | 1/2001 | Novak | |
| 6,179,753 | B1 | 1/2001 | Barker et al. | |
| 6,231,482 | B1 | 5/2001 | Thompson | 482/37 |
| 6,234,936 | B1 | 5/2001 | Wang | |
| 6,280,362 | B1 | 8/2001 | Dalebout et al. | |
| 6,312,363 | B1 | 11/2001 | Watterson et al. | |

OTHER PUBLICATIONS

Damark International, Inc. Mail Order Catalog, dated Nov. 17, 1994, cover page and p. 6.

Treadmill Owner's Manual by Formula 22100 Manual Treadmill, upon information and belief, available at least as early as 1998, 20 pgs.

Sears, Roebuck and Co., *Pro–Form 585 TL Low Profile Treadmill, User's Manual*, Copyright 1996.

*Primary Examiner*—Glenn E. Richman
(74) *Attorney, Agent, or Firm*—Workman Nydegger

(57) ABSTRACT

A selectively inclining hiking exercise apparatus supports a user ambulating thereon. The selectively inclining hiking exercise apparatus includes: (i) a support base; and (ii) a treadbase having a proximal end, a distal end, and an inner portion therebetween, the treadbase selectively inclining with respect to the support base. The treadbase is pivotally coupled at the inner portion thereof to the treadbase. A handrail assembly of the hiking apparatus adjusts automatically throughout the range of motion of the treadbase.

40 Claims, 17 Drawing Sheets

HIKING EXERCISE APPARATUS

BACKGROUND OF THE INVENTION

1. The Field of the Invention

This invention is in the field of exercise equipment. More specifically, this invention is in the field of climbing exercise apparatuses.

2. The Relevant Technology

The desire to improve health and enhance cardiovascular efficiency has increased in recent years. This desire has been coupled with the desire to exercise in locations which are compatible with working out within a limited space such as within an individual's home or exercise gym. This trend has led to an increased desire for the production of exercise equipment.

Climbing apparatuses have become very popular in recent years. Climbing requires a user to raise the user's knees in continual, strenuous strides. Climbing typically requires more exertion than mere walking on a flat surface. Consequently, the exercise of climbing can provide a more intense, challenging workout.

Climbing exercise apparatuses typically feature an endless moving assembly which is set on a significant angle and has a series of circulating foot supports, steps, or paddles. This configuration requires the exerciser to engage in continual climbing motions and allows the exerciser to simulate the movements of climbing up a steep incline. Angled, moving staircase-type devices are typical examples of such climbing apparatuses.

However, typical climbing apparatuses within the art are tall and often require more ceiling height than is available in an exerciser's home. This phenomenon is typically due at least in part to large moving steps or paddles which require a necessary amount of clearance above a floor. The steep angle of the climbing apparatuses also contributes to the height of the machines. Thus, such climbing apparatuses often require a high-ceiling gym, a warehouse, or a vaulted ceiling for use. Typical climbing apparatuses also comprise a variety of different, complicated moving parts.

Treadmill apparatuses also offer a popular form of exercise, e.g., running and walking. A variety of different styles of treadmills have been produced. Certain treadmill apparatuses which fit into a user's home incline from a neutral position to an inclined position, then decline back to the neutral position. However, typical treadmills fail to adequately provide a user with the kind of terrain experience encountered when climbing mountainous, rocky, and rough terrain. Furthermore, hiking typically requires a great deal of lateral movement i.e. side-to-side movement to stablize footings and leg movements. Typical treadmills, however, are designed for length rather than width. In other words, typical treadmills are long and thin.

Typical climbing exercise apparatuses and treadmills include handrail assemblies which enable a user to steady the user's body during use of the device. However, such handrail assemblies are typically in a fixed position or can be moved only when the apparatus is folded into a storage position. Handrail assemblies are generally not useful in a storage position. Instead, the handrail assemblies are generally only used when the treadmill is in an operational position.

What is therefore needed is an exercise apparatus which simulates the dynamic of natural terrain with its accompanying slopes and inclines and can fit into a user's home or another location with a limited ceiling height. What is also needed is an exercise machine with an improved, more widely useful handrail assembly. What is also needed is an exercise apparatus which is convenient to manufacture, assemble and service.

SUMMARY AND OBJECTS OF THE INVENTION

It is therefore an object of the invention to provide an improved exercise machine.

It is another object of the invention to provide a hiking-type exercise apparatus which can fit into locations having normal home ceiling heights.

It is another object of the invention to provide an exercise machine which enables inclining and declining without sacrificing the ability to grasp a handrail assembly.

It is another object of the invention to provide an exercise machine having a selfadjusting handrail assembly.

It is another object of the invention to provide an exercise machine having a treadbase configuration which allows convenient use and storage of the exercise machine.

It is another object of the invention to provide an exercise machine having a treadbase which is pivotally coupled to the support base thereof in a convenient and efficient manner.

It is another object of the invention to provide a hiking-type exercise apparatus which is conveniently stored and used.

It is another object of the invention to provide a hiking-type exercise apparatus which does not require the use of cumbersome stairs or foot supports.

It is another object of the invention to provide a hiking-type exercise apparatus having a small footprint, yet enabling substantial inclining.

It is another object of the invention to provide a hiking-type exercise apparatus which allows lateral movement and other movements made during hiking.

A hiking-type exercise apparatus of the present invention comprises a selectively inclining and selectively declining treadbase. The treadbase is pivotally coupled to a support base configured to be mounted on a support surface. In a neutral position, the treadbase is substantially parallel to the support surface. The distal end of the treadbase selectively inclines above the neutral position and selectively declines below the neutral position.

The treadbase is capable of inclining to extreme angles, such that the distal end of the treadbase is high above the neutral position. This extreme inclining, coupled with the optional declining dynamic, enables an exerciser to selectively simulate a hiking motion in upward or downward directions, similar to a typical up and down hike across a mountainous peak. Optionally, it is possible to walk or run with the treadbase in a flat, neutral position, which can also be found on occasion during hikes in the mountains. Thus, the hiking apparatus of the present invention is designed to closely simulate a typical mountainous terrain.

The pivotal coupling of the treadbase to the support base may occur in a variety of different locations depending upon the particular embodiment of the present invention. In one embodiment, the treadbase is pivotally coupled remotely from an end thereof to the support base. This remote coupling improves the leverage of the system and conserves space and motor output, improving the ability to incline or decline the treadbase to extreme angles in a limited space, such as within a user's home. The remote coupling also enables the treadbase to incline or decline without vertically raising the ambulating surface of the moving belt significantly with respect to a handrail assembly supporting the user's hands. The hiking apparatus also achieves hiking-type angles with relatively simple parts.

The aspect ratio, i.e., the length and width of treadbase is also such that the hiking apparatus simulates a hiking motion and allows significant lateral movement, yet has a minimal footprint and can be conveniently used and stored in a home or exercise gym.

As another advantage, in one embodiment, a handrail assembly of the hiking apparatus moves upwardly as the treadbase moves upwardly, and also moves downwardly in correspondence with the treadbase. The position of the handrail assembly adjusts automatically throughout the range of motion of the treadbase. This supports the hands of the user even at extreme incline and decline levels. In one embodiment, the handrail assembly comprises a two-part movable, telescoping handrail assembly.

Thus, the present invention enables a user to exercise at inclined and declined angles without sacrificing the ability to grasp a handrail assembly. In one embodiment, the handrail assembly adjusts as the treadbase adjusts. In another embodiment, the treadbase inclines and declines without being vertically raised to heights which prohibit grasping of the handrail assemblies. Other embodiments are also available which enable inclining/declining without sacrificing handrail grasping.

As mentioned, one feature of the hiking apparatus of the present invention is that it allows significant lateral movement capability of feet, thereby more accurately simulating the movements performed during hiking. This lateral movement potential is particularly improved by employing an improved belt aspect ratio. In one embodiment, the width of the endless belt is at least ½ the size of the length of the belt (the length of the belt being measured from the center of the proximal treadbase roller to the center of the distal treadbase roller).

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
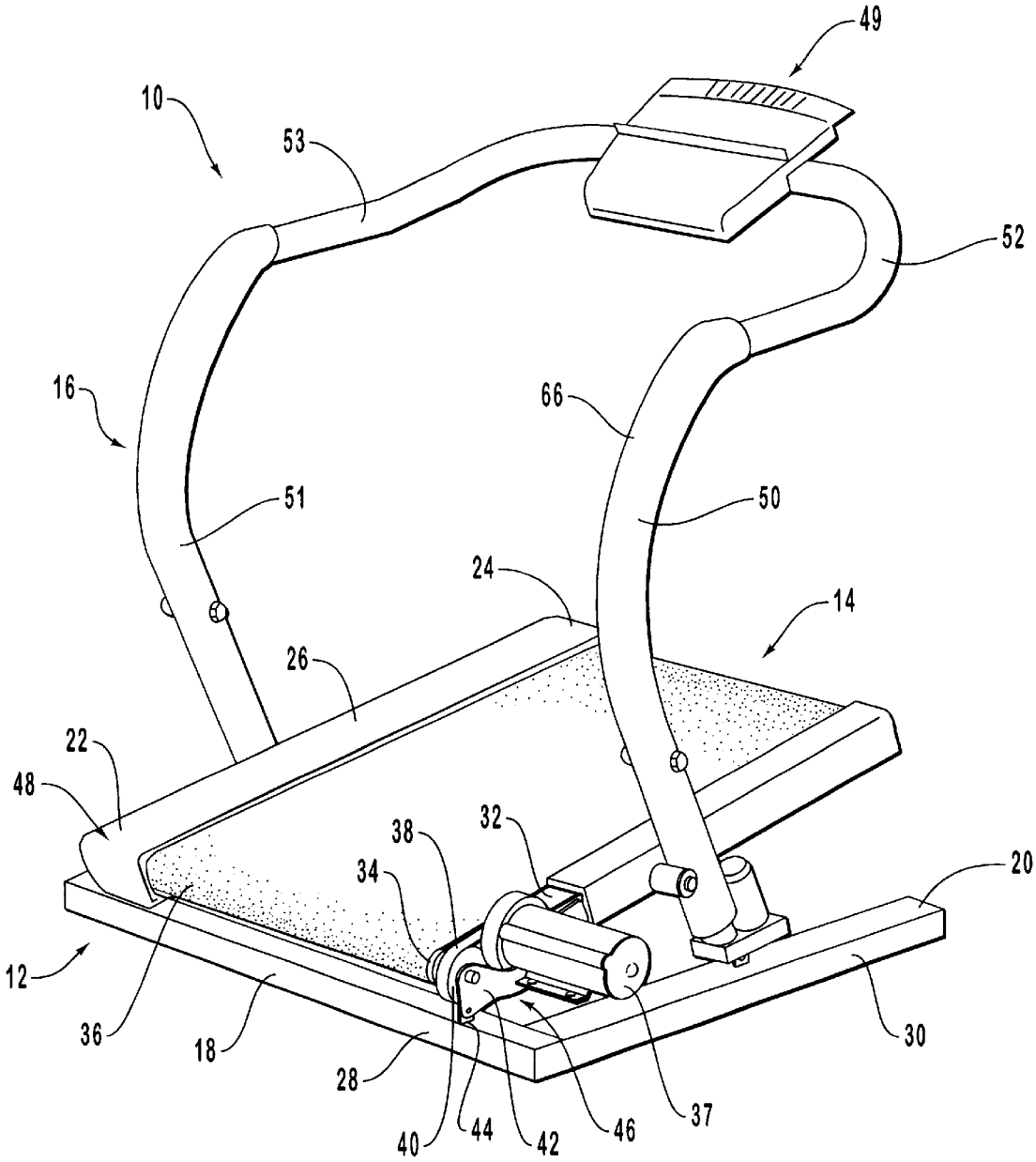
FIG. 1 is a perspective view of a hiking exercise apparatus of the present invention.

With reference now to FIGS. 1–4, a selectively inclining and selectively declining hiking exercise apparatus 10 of the present invention is shown. Exercise apparatus 10 supports a user ambulating thereon in a hiking, running, or walking mode.

Selectively inclining and declining apparatus 10 comprises a support base 12, a treadbase 14, and a handrail assembly 16. Support base 12 has a proximal end 18 and a distal end 20. Treadbase 14 has a proximal end 22, a distal end 24, and an inner portion 26 therebetween. Treadbase 14 is pivotally coupled to support base 18.

Figure 2:
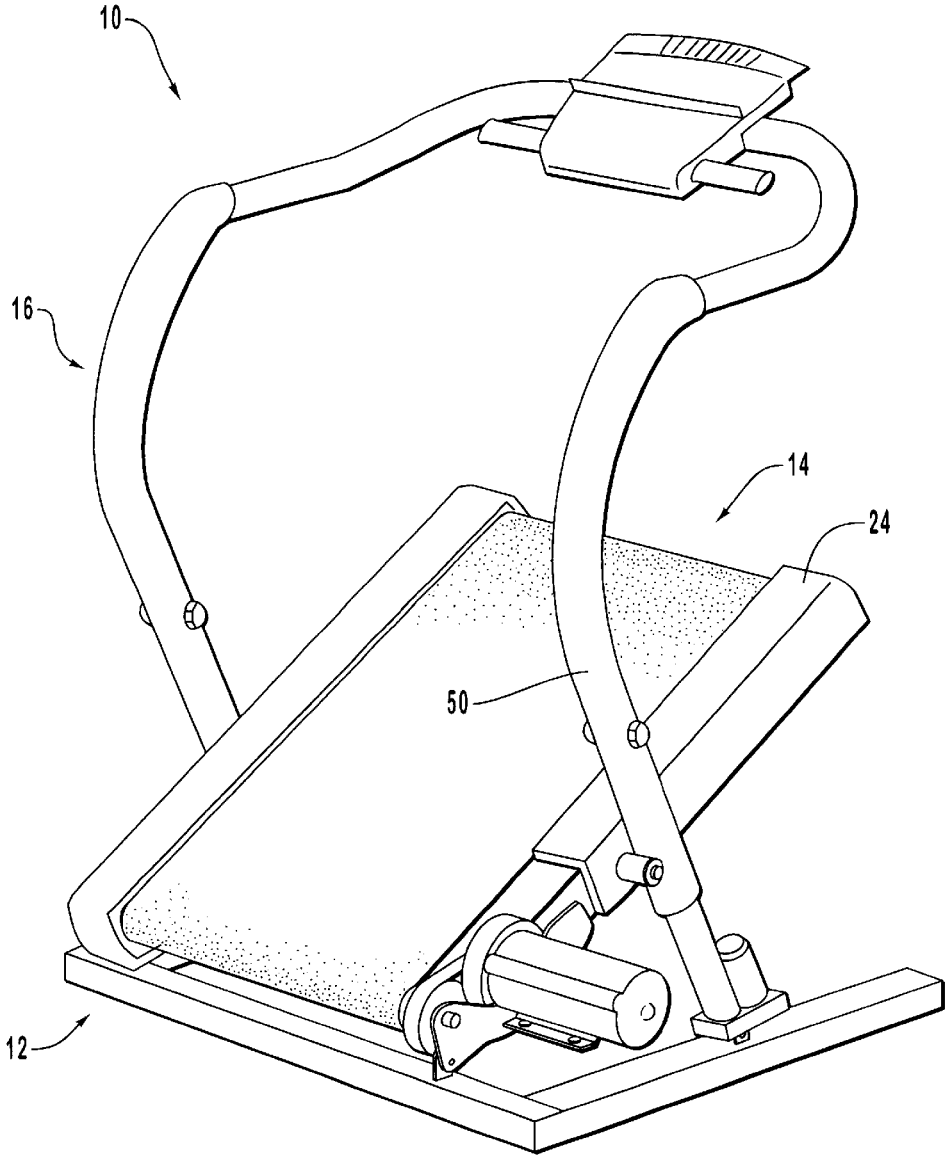
FIG. 2 is a perspective view of the apparatus of FIG. 1 with the treadbase in an inclined position.
Figure 3:
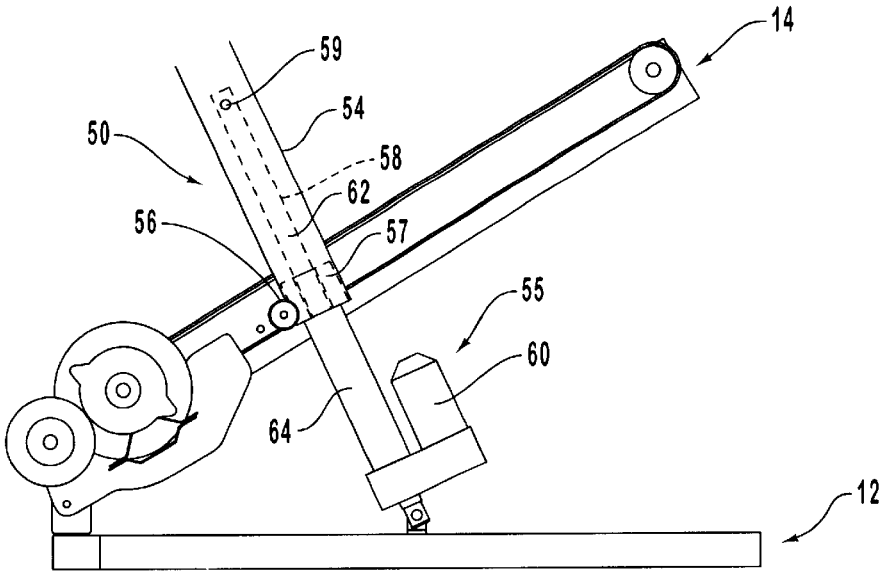
FIG. 3 is a side cut-away view of the apparatus of FIG. 1 with the treadbase shown in an inclined position.
Figure 4:
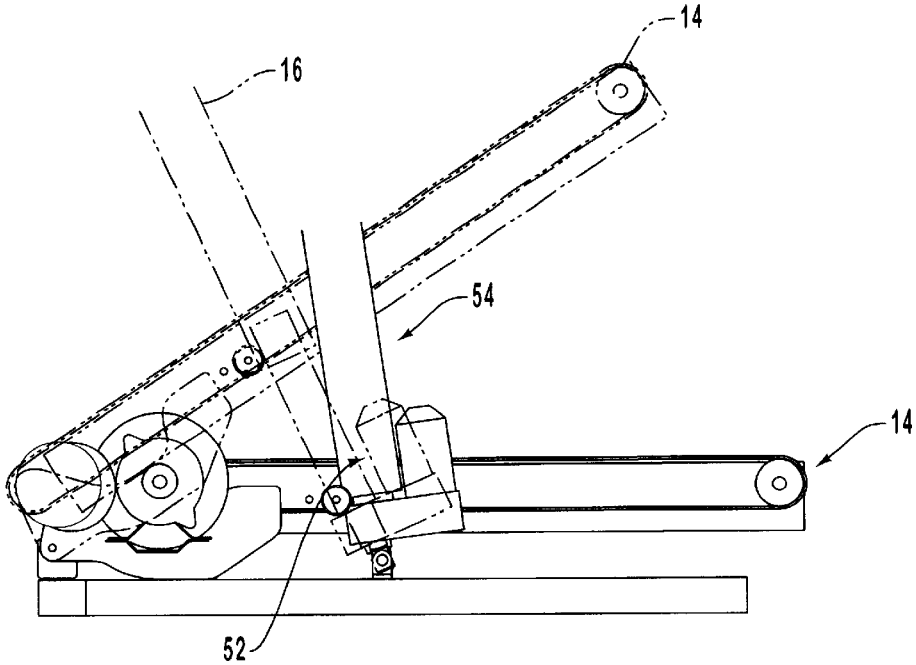
FIG. 4 is a side cut-away view of the apparatus of FIG. 3 with the treadbase shown in a neutral position, and a raised position featured in phantom view.

As depicted in FIGS. 1–3, in an inclined position, treadbase 14 is capable of inclining to extreme angles, such that distal end 24 is high above the neutral position. This enables an exerciser to simulate a hiking motion which requires the user to continually lift the user's knees in an upward, outstretched manner. In a neutral position, (as shown in FIG. 4), treadbase 14 is substantially parallel to a support surface.

Treadbase 14 also declines into a declined position in which distal end 24 drops below the neutral position. An example of a such a declined position will be discussed further below with reference to FIG. 19. Typical hikes in the mountains, for example, involve both inclines and declines as well as flat surfaces, each of which can be accommodated by treadbase 14. Thus, apparatus 10 is able to more closely simulate a typical mountainous terrain.

Handrail assembly 16 moves upwardly as treadbase 14 moves upwardly, thereby supporting the hands of the user even at extreme inclined levels. The length and width of treadbase 14 is such that hiking apparatus 10 simulates a hiking motion, yet has a minimal footprint and can be conveniently used and stored in a home or exercise gym.

The coupling of treadbase 14 may occur in a variety of different positions depending upon the embodiment. A variety of different coupling positions and embodiments are disclosed herein. However, in the embodiment of FIG. 1, treadbase 14 is pivotally coupled at proximal end 22 thereof to proximal end 18 of support base 12.

A variety of different embodiments of support bases may be employed in the present invention. The support base rests on a support surface. The treadbase is mounted thereon. Support base 12 of FIG. 1 is comprised of a cross member 28 and first and second opposing side members 30 (only one side member 30 shown) extending distally therefrom.

Treadbase 14 may also be comprised of a variety of different members. In the embodiment of FIG. 1, treadbase 14 comprises a treadbase frame 32, first and second rollers 34 (only one roller 34 shown) on proximal and distal ends of frame 32, respectively, and an endless belt 36 movably mounted on rollers 34. Endless belt 36 is movably trained about the rollers.

Treadbase 14 further comprises a motor 37 coupled to treadbase frame 32. Treadbase 14 also comprises a drive belt 38 mounted on (i) a flywheel pulley coupled to motor 37; and (ii) a roller pulley coupled to roller 34. Actuation of motor 37 rolls roller 34, thereby turning endless belt 36. Treadbase 14 further comprises a coupling plate 42 coupled to treadbase frame 32. Coupling plate 42 pivotally couples to support base 12, e.g., by being pivotally coupled to a bracket 44 of base 12 through the use of a pin extending through plate 42 and bracket 44.

A first side 46 of proximal end 22 of treadbase 14 is thus pivotally coupled to proximal end 18 of support base 12. An opposing second side 48 of proximal end 22 of treadbase 14 from plate 42 is also pivotally coupled to support base 12, such as through the use of corresponding brackets on base 12 and treadbase 14 and a pin disposed therethrough (not shown).

As mentioned above, treadbase 14 selectively moves between an inclined position (FIGS. 1–3) in which distal end 24 is above a neutral position (FIG. 4) and a declined position, in which distal end is below the neutral position.

In one embodiment, the treadbase of the present invention is selectively moved into a position having a grade of about −30% (declined) with respect to the neutral position to about 90 degrees (inclined) with respect to the neutral position, preferably having a grade of about −20% (declined) with respect to the neutral position to about 60 degrees (inclined) with respect to the neutral position, more preferably, having a grade of about −10% with respect to the neutral position to about 100% (45 degrees) with respect to the neutral position, more preferably, having a grade of about −10% with respect to the neutral position to about 60% with respect to the neutral position. In another embodiment, the treadbase of the present invention is selectively moved into a position having a grade of about −5% with respect to the neutral position to about 50% or 60% with respect to the neutral position.

Hiking apparatus 10 is able to achieve an improved inclining/declining dynamic without requiring the use of a high stack of moving steps, paddles or foot supports. Instead, a vigorous hiking dynamic can be achieved in a significantly lower room because clearance for steps, paddles, and supports is not necessary. Instead, the moving belt which acts as the ambulating surface for a user, can be adjacent the support surface even in the most intensely angled position.

By moving between these extreme ranges, an exerciser is able to simulate a hike or journey through a variety of different slopes and angles. The amount of inclination/declination can be controlled by an electronic control system 49 electrically coupled to inclination motor 60 discussed below. Electronic control system 49 also controls belt speed and a variety of other features.

An example of one electronic control system 49 to be employed in the present invention is disclosed in U.S. Patent Application to Ashby, et al, entitled "System and Method for Selective Adjustment of Exercise Apparatus," filed on Feb. 2, 2000 which is incorporated herein in its entirety by reference.

In one embodiment, electronic control system 49 includes an electronic braking system for slowing the speed of the treadbase, thereby preventing a user from driving belt 36 faster than the speed driven by motor 37. The braking system can prevent the user from driving belt 36 so fast that the user falls off belt 36. In one embodiment, the electronic braking system is part of a four quadrant or two quadrant controller. In one embodiment, the braking system comprises a transducer, a DC motor, an alternator, or other means for recapturing power generated by the user, each of which are additional examples of braking means for slowing the speed of the treadbase. Power generated through the use of a transducer, DC motor, or alternator, for example, can then be used to provide power to the electronic control system, the treadbase motor, or another motorized system, e.g., motor 60. In yet another embodiment, the braking means for slowing the speed of the treadbase comprises a strap extending about a flywheel or pulley. Upon increasing the tension of the strap, a braking force is applied.

As mentioned above, the aspect ratio, i.e., the length and width of treadbase 14 is such that hiking apparatus 10 simulates a hiking motion, yet has a minimal footprint and can be conveniently used and stored in a home or exercise gym. In order to compensate for the intensity of the workout and to allow for lateral, i.e., side to side, movements common during hiking, in one embodiment, belt 36 is wider than typical treadmill belts. This dynamic provides an exerciser with lateral movement which is highly desireable during hiking, such as during inclining, declining and ambulating over rough terrain.

In one embodiment, the width of the endless belt 36 is at least one half the size of the length of the belt (the length of the belt being measured from the center of the proximal treadbase roller to the center of the distal treadbase roller). In another embodiment, the width of the belt is at least 55% the size of the length of the belt.

In one embodiment, belt 36 of treadbase 14 has a width of about 12 inches to about 48 inches and a length of about 24 inches to about 120 inches, measured from the center of a proximal roller to the center of a distal roller. Preferably, belt 26 is about 16 inches to about 30 inches in width and about 30 inches to about 60 inches in length, more preferably about 18 inches to about 26 inches in width and about 30 inches to about 50 inches in length.

In one embodiment, belt 36 of treadbase 14 is about 24 inches in width and about 33 inches in length, measured from the center of a proximal roller to the center of a distal roller. In another embodiment, the belt is approximately 20–24 inches in width and about 36 inches in length. For example, belt 36 can be about 20, 22, or 24 inches in width and about 36 inches in length. Optionally, the belt has a length of approximately 32–33 inches and a width of approximately 26 inches.

In another embodiment, belt 36 has a width of about 18 inches or more and a length of about 40 inches or less (the length of the belt being measured from the center of the proximal treadbase roller to the center of the distal treadbase roller). In yet another embodiment, belt 36 has a width of about 20 inches or more and a length of about 39 inches or less (the length of the belt being measured from the center of the proximal treadbase roller to the center of the distal treadbase roller). Consequently, the desired amount of lateral movement can be achieved while minimizing the footprint of apparatus 10.

The ranges and aspect ratios described herein are particularly useful when employing an apparatus such as a described herein which is designed to (i) simulate a hike in the mountains with the accompanying necessity of lateral movement potential; and (ii) provide a minimal foot print which uses the least space in a user's home or gym.

Handrail assembly 16 will now be discussed in additional detail with reference to FIGS. 1–4. In the embodiment of FIGS. 1–4, in order to compensate for the movement of treadbase 14, handrail assembly 16 selectively moves up and down as treadbase 14 inclines and declines, respectively. Thus, both handrail assembly 16 and treadbase 14 have upper and lower operational positions and can be selectively moved therebetween.

In the embodiment of FIGS. 1–4, handrail assembly 16 comprises: (i) first and second upstanding members 50, 51, each of which are pivotally coupled to support base 12 and treadbase 14; and (ii) first and second substantially horizontal support members 52, 53 respectively, coupled thereto. Support members 52, 53 can be coupled to each other or coupled to system 49.

Handrail assembly 16 is coupled to the treadbase 14 such that the position of handrail assembly 16 adjusts automatically throughout the range of motion of treadbase 14 (e.g., the range of motion between the inclined position of FIG. 2 and the declined position). Thus, handrail assembly is useful to the exerciser throughout the range of motion of treadbase 14. In other words, a user can grasp handrail assembly 16 throughout the range of motion of treadbase 14 to support the user throughout the range of motion. Furthermore, support members 52, 53 of handrail assembly 16 remain substantially horizontal, i.e., substantially parallel to a horizontal support surface (and can therefore be conveniently grasped by a user), despite movement of both treadbase 14 and handrail assembly 16 as treadbase 14 moves between the inclined position of FIG. 2 and the declined position.

Thus, handrail assembly 16 has an operative, useful position when treadbase 14 is in an inclined, declined, and neutral position. Handrail assembly 16 extends substantially vertically as treadbase 14 inclines or declines. Handrail assembly 16 raises and lowers as treadbase 14 inclines and declines, respectively. Assembly 16 is thus useful in any of these positions.

The automatic adjusting nature of handrail assembly 16 is useful at inclines such as in excess of about 15% grade and is particularly useful at high inclines, such as in excess of about 25% grade. In light of this automatic adjusting, the handrail is useful in a variety of different inclined and declined positions.

With reference now to FIGS. 3–4, each upstanding member 50, 51 (only member 50 shown in FIGS. 3–4) comprises a hollow upper portion 54 pivotally coupled to treadbase 14 and a lower portion 55 pivotally coupled to support base 12. Upper and lower portions 54, 55 are movably coupled to each other.

Upper portion 54 is coupled to a sleeve 56 which pivots about an axle coupled to treadbase 14. Thus, upward movement of upper portion 54 moves treadbase 14 upwardly as upper portion 54 rotates slightly with respect to treadbase 14.

In FIGS. 3–4, upper portion 54 comprises a female member 62, while lower portion 55 comprises a male member 64, although the male and female positions can be reversed or another movable coupling relationship can be employed. Upper and lower portions, 54, 55 are telescopically coupled to each other.

A bushing 57 is disposed within female member 62 of upper portion 54 and slides on male member 64 as upper portion 54 moves up and down. Lower portion 55 further comprises a selectively extendable member 58 which extends into upper portion. Member 58 is coupled at 59 to upper portion 54 and selectively drives upper portion 54 upwardly or downwardly with respect to lower portion 55.

Selectively extendible member 58 extends from the male member and is moved back and forth by inclination motor 60 which drives member 58 and is controlled by electronic control system 49, as discussed above. Lower portion 55, thus comprises selectively extendable member 58, motor 60, and male member 64. Lower portion 55 is an example of a linear extending assembly. A "linear extending assembly" as referred to in this specification and the appended claims is an assembly having a first member (e.g., member 58) which selectively moves with respect to a second member (e.g., member 64).

Examples of linear extending assemblies having a first member which selectively moves with respect to a second member and which may be employed in the present invention to lift a treadbase include: a ram such as a hydraulic or pneumatic ram, a drive screw with an accompanying nut or internal threading, a linear actuator, an extension motor, a piston, another telescoping assembly, and any other assembly having a first member which is selectively linearly extended with respect to a second member.

Each of these examples of linear extending assemblies is an example of means for selectively moving a treadbase, such as treadbase 14. Lower portion 55, for instance, selectively moves treadbase 14 between an upper, inclined position and a lower, declined position. Actuation of motor 60 selectively moves the two-part telescoping assembly comprising upper and lower portions 54, 55 of handrail assembly 16 between a contracted position and an extended position.

Handrail assembly 16 is thus an example of means pivotally coupled to support base 20 and treadbase 14 for supporting at least one arm of a user ambulating on treadbase 14. The selective movement of handrail assembly 16 results in selective upward and downward movement of treadbase 14. Thus, actuation of motor 60 moves handrail assembly 16 and at the same time selectively inclines or declines treadbase 14.

Figure 6:
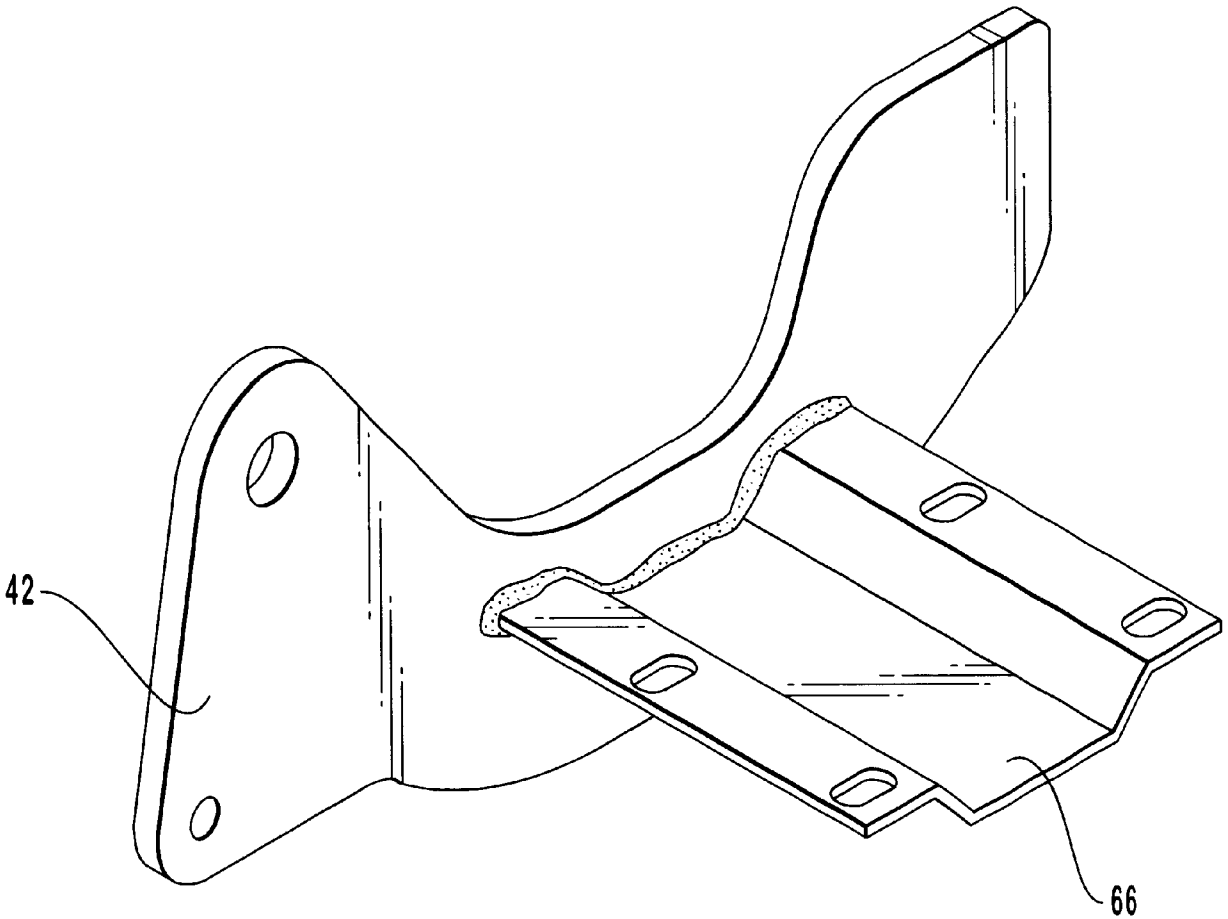
FIG. 6 is a perspective view of the support plate and motor base of the apparatus of FIG. 1.
Figure 6B:
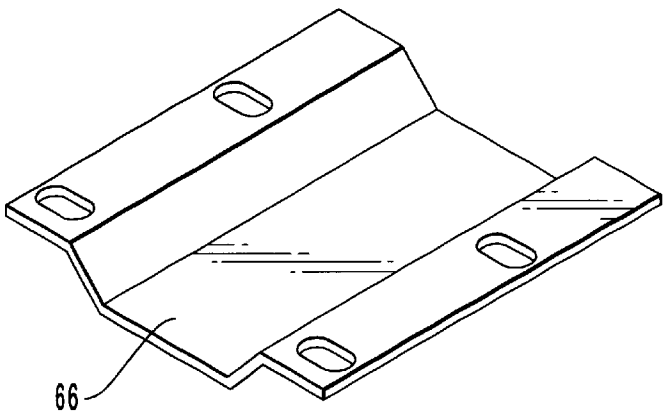
FIGS. 6*a* and 6*b* feature the plate and base of FIG. 6.
Figure 6A:
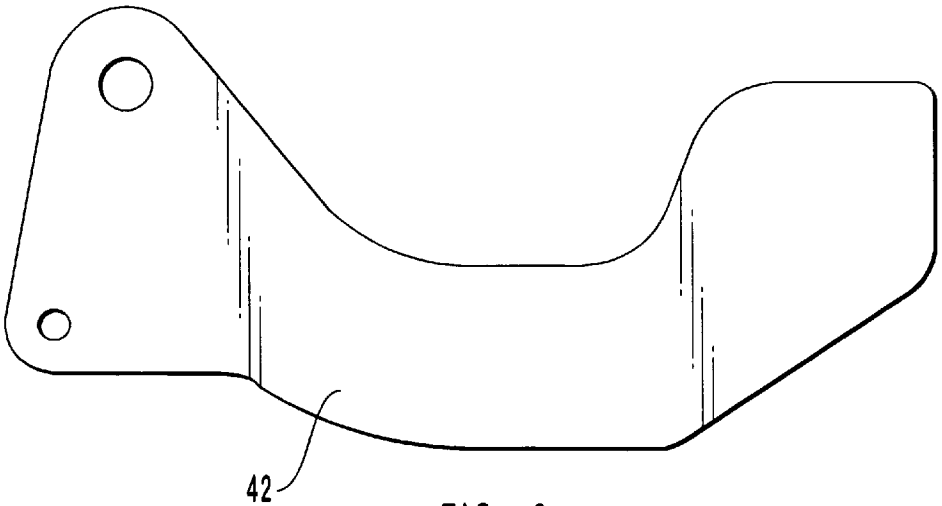

In one embodiment, first and second motors 60 are mounted on opposing sides of handrail assembly 16, one on each respective upstanding member 50, 51. In yet another embodiment, a handrail assembly of the present invention is a single piece, fixed assembly which does not selectively extend and contract, such as discussed in greater detail below. Adaptor plate 42 is further shown in FIG. 6 with motor base 66 shown coupled thereto. Base 66 is configured to receive motor 36 thereon. Plate 42 and base 66 are shown in FIGS. 6*a* and 6*b* respectively.

As another advantage of handrail assembly 16, handrail assembly 16 inclines and declines at a different rate than the distal end 24 of treadbase 14. Since handrail assembly 16 inclines and declines at a different rate than distal end 24 of treadbase 14, handrail assembly 16 does not rotate dramatically backward when treadbase 14 inclines, for example. This dramatic rotation backward could cause the support members of the handrail assembly to incline dramatically such that the support members are no longer substantially parallel to a horizontal support surface—particularly at extreme inclines, making it more difficult to grasp the support members. Support members 52, 53, however, remain substantially horizontal, i.e., substantially parallel to a horizontal support surface (and can therefore be conveniently grasped by a user), despite movement of both treadbase 14 and handrail assembly 16 as treadbase 14 moves between the inclined position of FIG. 2 and the declined position. This advantage is achieved in part because handrail assembly 16 inclines and declines at a different rate than the distal end 24 of treadbase 14.

Figure 8:
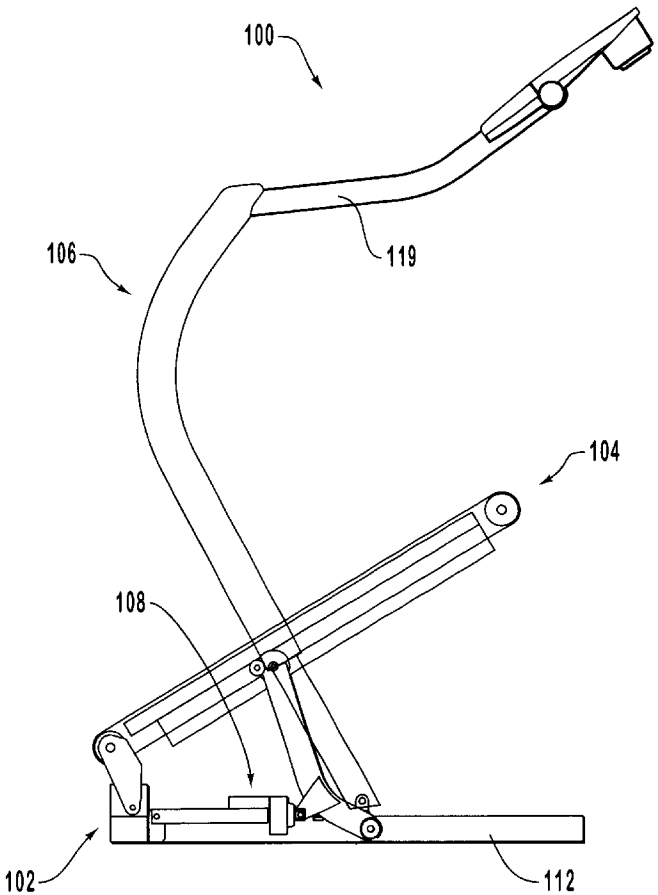
FIG. 8 is a schematic view of the exercise apparatus of FIG. 7 with the treadbase shown in an inclined position.
Figure 7:
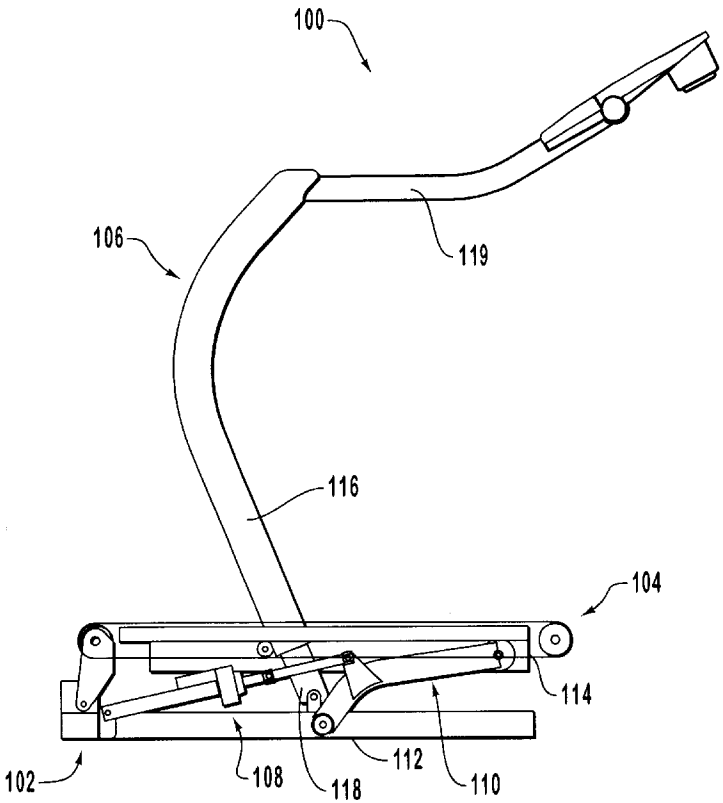
FIG. 7 is a schematic view of an alternative hiking exercise apparatus of the present invention with the treadbase shown in a neutral position.

An alternative hiking exercise apparatus 100 of the present invention is shown in FIG. 7 (showing the neutral position of the treadbase) and FIG. 8 (showing the inclined position of treadbase). Apparatus 100 comprises a support base 102, a treadbase 104 movably coupled at a proximal end thereof to support base 102 and handrail assembly 106 pivotally coupled to treadbase 104 and support base 102. As shown, upon selectively raising treadbase 104, handrail assembly 106 is selectively raised.

The means for selectively moving treadbase 104 shown in FIGS. 7 and 8 comprises (i) a linear extending assembly in the form of an extension motor 108; and (ii) a rotating lever 110. Motor 108 is pivotally coupled to base 102 at one end thereof and pivotally coupled to rotating lever 110 at an opposing end. Rotating lever 110 is pivotally coupled at a lower end thereof 112 to support base and has at an upper end thereof a rotating wheel 114. Wheel 114 selectively rolls against treadbase 104.

When extension motor 108 is selectively extended, as shown in FIG. 7, lever 110 moves downwardly. Further extension of motor 108 from the position of FIG. 7 moves treadbase 104 to a declined position. However, upon contraction of motor 108 as shown in FIG. 8, lever 110 is raised upwardly such that treadbase 104 is raised as a result thereof. In one embodiment, first and second levers 110 having wheels thereon are pivotally coupled on opposing sides of support base 102 to thereby selectively lift opposing sides of treadbase 104 such that each side of treadbase 104 receives a rolling lever thereon. The levers may be coupled to each other by a cross beam, for example. The coupled levers may each have a motor associated therewith or a single motor may drive both levers. However, a single lever 110 may also be employed.

FIGS. 7 and 8 also show another example of a two-part movable, telescoping handrail assembly 106. An upper portion 116 of assembly 106 is pivotally coupled to treadbase 104, while a lower portion thereof 118 is pivotally coupled to support base 102. Lower portion 118 fits within upper portion 116 and upper portion 116 slides thereon during the movement of treadbase 104. Handrail assembly 106 is coupled to treadbase 104 such that the position of handrail assembly 106 adjusts automatically throughout the range of motion of the treadbase 104. Assembly 106 is useful throughout the range of motion and the first and second opposing support members 119 (only one shown) remain substantially horizontal despite movement of the treadbase 104 and the handrail assembly 106 as the treadbase moves between an inclined position and a declined position. Assembly 106 is another example of means pivotally coupled to support base 102 and treadbase 104 for supporting at least one arm of a user ambulating on the treadbase 104.

Figure 10:
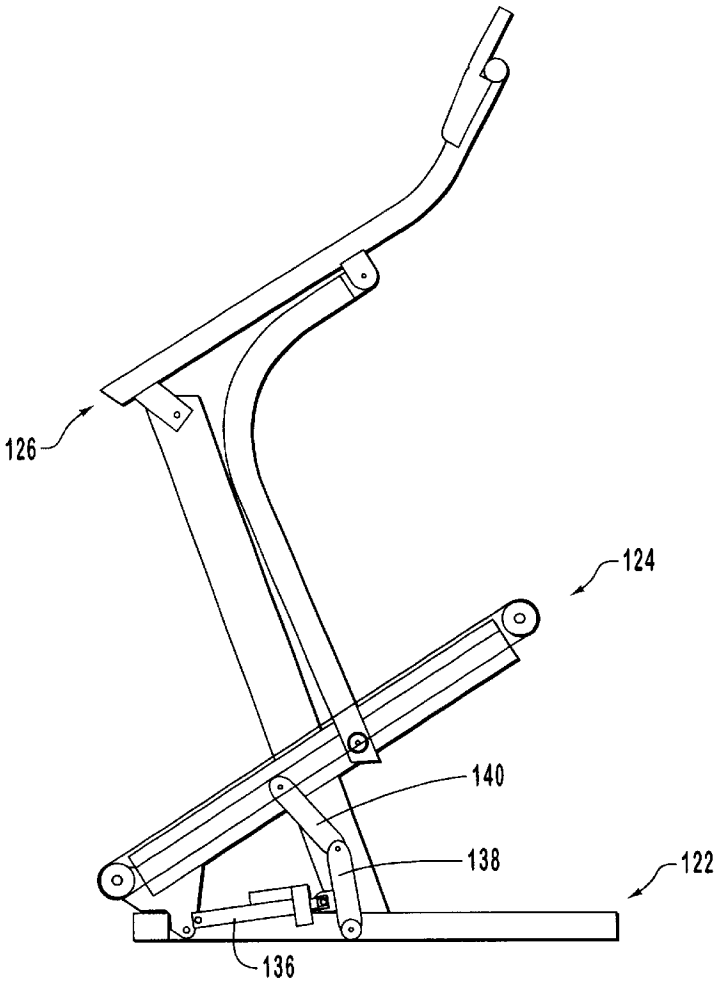
FIG. 10 is a schematic view of the exercise apparatus of FIG. 9 with the treadbase shown in an inclined position.
Figure 9:
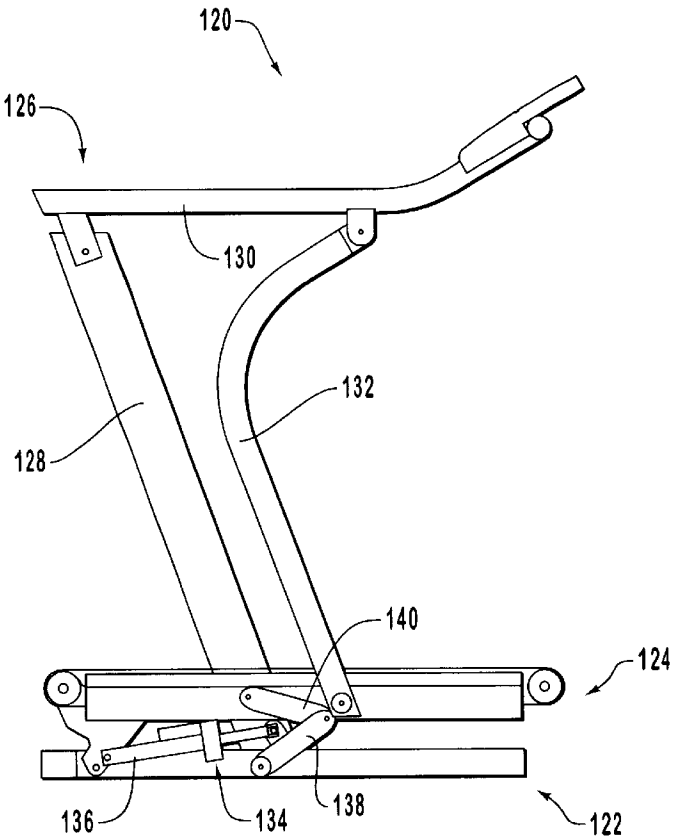
FIG. 9 is a schematic view of an alternative hiking exercise apparatus of the present invention with the treadbase shown in a neutral position.

An alternative hiking exercise apparatus 120 of the present invention is shown in FIG. 9 (showing the neutral position of the treadbase) and FIG. 10 (showing the inclined position of the treadbase). Apparatus 120 comprises a support base 122, a treadbase 124 movably coupled at a proximal end thereof to support base 122 and handrail assembly 126 coupled to support base 122 and treadbase 124. As shown, upon raising treadbase 124, handrail assembly 126 is selectively raised.

The means for selectively moving treadbase 124 shown in FIGS. 9 and 10 comprises (i) a linear extending assembly in the form of an extension motor 134; and (ii) a pair of pivoting scissor-type members 138, 140. Motor 134 is pivotally coupled to base 122 at one end thereof and pivotally coupled to at least one of the pivoting members (e.g., 138) at an opposing end thereof. Members 138, 140 are pivotally coupled at one end thereof to each other and at opposing ends thereof to support base 122 and treadbase 124, respectively. When extension motor 134 is selectively extended, as shown in FIG. 9, members 138, 140 are in a contracted position such that the position of treadbase 124 is neutral. Upon further extension of motor 134, treadbase 124 declines. However, upon contraction of motor 134 as shown in FIG. 10, members 138, 140 extend such that treadbase 124 is raised as a result thereof.

In one embodiment, a cross beam is coupled between first and second opposing sets of first and second pivotally coupled members, 138, 140 (e.g., by being coupled to members 138) with one set being on each side of apparatus 120. In one embodiment, motor 134 is coupled to the beam, rather than being directly coupled to the sets of pivotally coupled members. However, a single set of members 138, 140 may also be employed.

FIGS. 9 and 10 show an example of a handrail assembly 126 comprising: (i) an upright member 128 affixed to support base 122; and (ii) a pivotting, movable second upright member 132 pivotally coupled to treadbase 122 and pivotally coupled to a substantially horizontal support member 130. Member 130 is also pivotally coupled to fixed upright member 128. As shown in FIG. 10, handrail assembly 126 is coupled to treadbase 124 such that the position of handrail assembly 106 adjusts automatically throughout the range of motion of the treadbase 124 and is useful throughout the range of motion of treadbase 124.

As will be appreciated from a review of this disclosure, it is not required that the handrail assembly be movably coupled to the support base or the treadbase. In other embodiments of this invention, the handrail assembly is affixed to the support base while the treadbases selectively inclines and declines.

For example, with reference now to FIGS. 11–14, an alternate hiking exercise apparatus 141 is shown. Apparatus 141 comprises a support base 142, a treadbase 144 movably coupled at a proximal end thereof to support base 142 and handrail assembly 146 coupled to support base 142.

Figure 11:
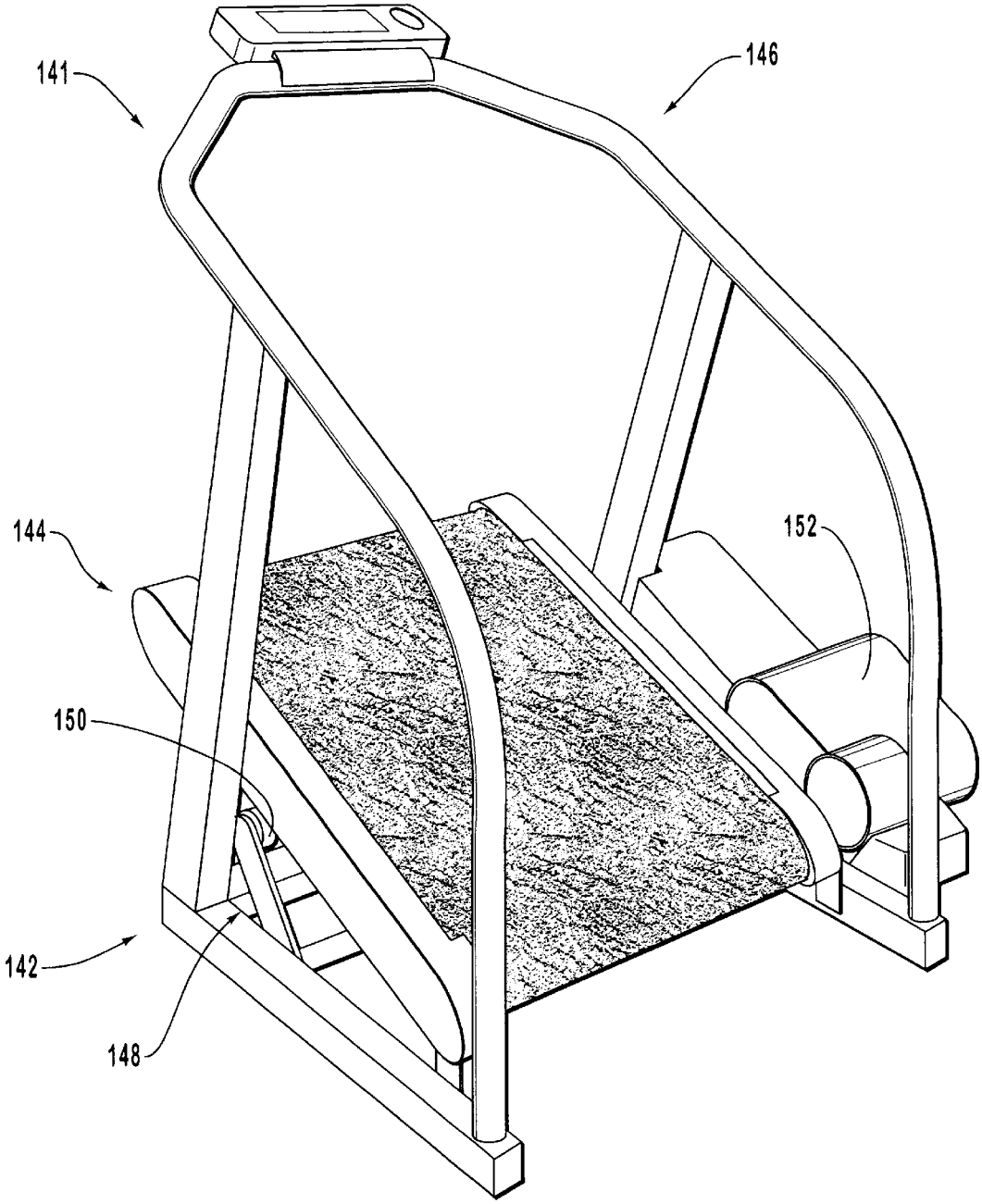
FIG. 11 is a view of an alternative hiking exercise apparatus of the present invention.
Figure 12:
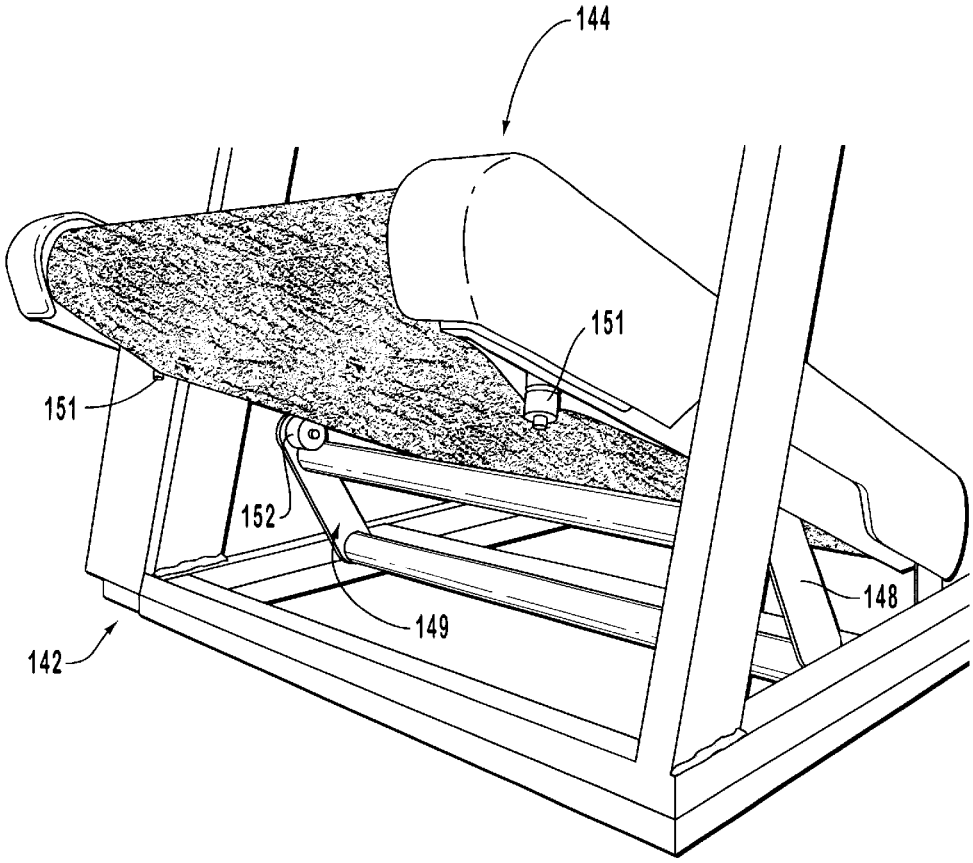
FIG. 12 is a front cut-away view of the exercise apparatus of FIG. 11.

The means for selectively moving treadbase 144 shown in FIGS. 11–14 comprises (i) a linear extending assembly in the form of an extension motor 164 (FIGS. 13–14); and (ii) a pivotting lever 148. Motor 164 is pivotally coupled to base 142 at one end thereof and pivotally coupled to pivotting lever 148 at an opposing end. Pivotting lever 148 is pivotally coupled at a lower end thereof 112 to support base and has at an upper end thereof a rotating wheel 150 (FIGS. 11–12). Wheel 150 rolls against treadbase 104. Rolling belt guides 151 on opposing sides of the endless belt maintain the belt in a desired, aligned position on the treadbase rollers. Each guide 151 comprises a wheel rolling on an axle. These guides 151 are useful at extreme inclines and prevent the belt from sliding from one side to another.

Figure 13:
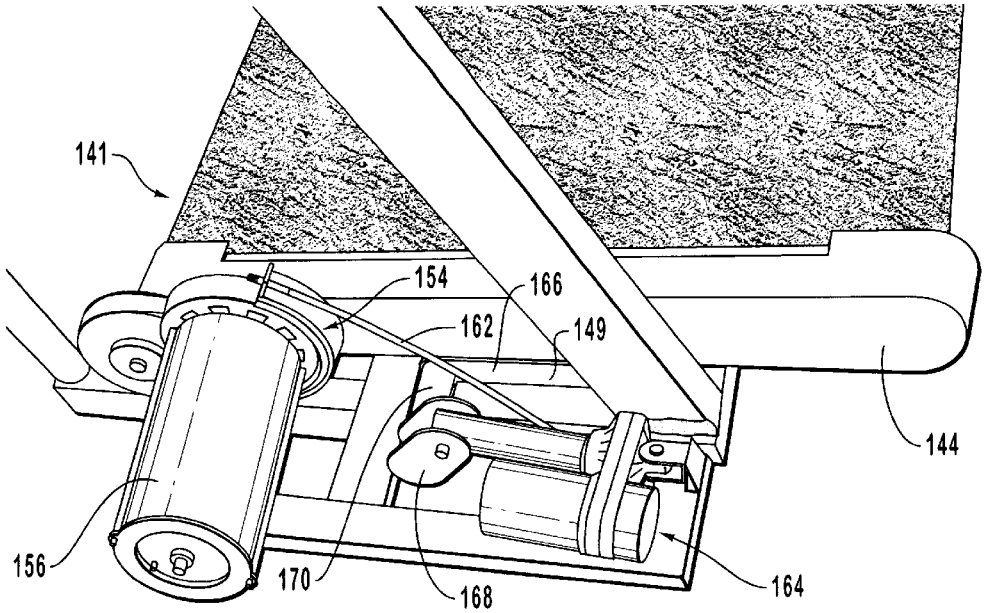
FIG. 13 is a side cut-away view of the exercise apparatus of FIG. 11 with the treadbase shown in a neutral position.
Figure 14:
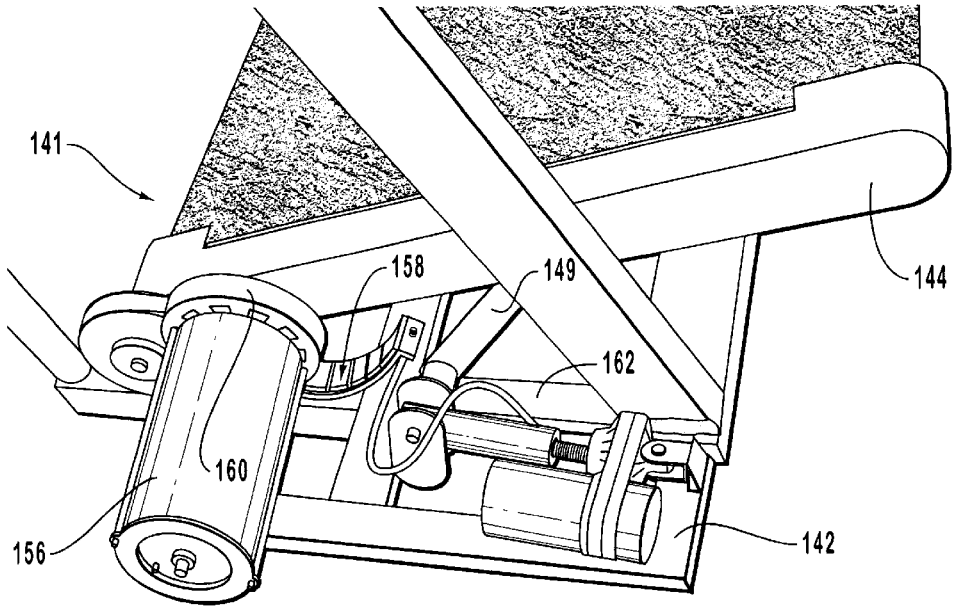
FIG. 14 is another side cut-away view of the exercise apparatus of FIG. 11 with the treadbase shown in an inclined position.

Upon selective contraction of linear extending assembly 164 as shown in FIG. 13, lever 148 is moved downwardly. When extension motor 164 is selectively extended to an extended mode, as shown in FIG. 14, lever 148 is in an upward position such that the position of treadbase 144 is inclined. In one embodiment, as shown in FIG. 12, first and second levers 148, 149 having wheels thereon are coupled to opposing sides of support base 142 such that each end of treadbase 144 receives a rolling lever thereon. However, a single lever 148 may also be employed. Also as shown in FIGS. 13 and 14 (which is shown in a cut-away view from a side thereof with a cosmetic hood 152 shown in FIGS. 11–12 removed), beam 166 of lever 149 is coupled to a lever bracket 168 by a cross member which extends through a sleeve 170 coupled to support base 142. Extension motor 164 is pivotally coupled to bracket 168.

Also as shown in the embodiments of FIGS. 13 and 14, hiking apparatus 140, further comprises a braking system 154 which prevents the belt of treadbase 144 from being moved by a user faster than a certain desired speed. Braking system 154 comprises and eddy magnet comprising a magnetic member 158 coupled adjacent the fly wheel 160 of motor 156. Magnetic member 158 is secured in a desired position by a cord 162 coupled to base 142.

Braking system 154 is another example of braking means for slowing the speed of the treadbase. However, the braking means can be any force that opposes the normal direction of the travel of the belt when the belt exceeds a certain speed. The fly wheel adjacent the eddy magnet preferably has a strip of copper thereon or another nonferrous metal. The braking system prevents the belt from exceeding a certain speed so that a user does not fall off. The braking system is useful at inclines such as in excess of about 15% grade and is particularly useful at high inclines, such as in excess of about 25% grade.

A variety of other braking means for slowing the speed of the treadbase are also available for use on the apparatuses disclosed herein, such as an electronic assembly in an electronic control system (as discussed above with respect to system 49, e.g., a two-phase controller), a friction brake, a gear brake, a disk brake, a band, a motor which drives in an opposite direction, a portion of a motor which is an integral braking system, a motor geared not to exceed a certain speed, and a variety of other such assemblies, and a variety of other braking systems such as the braking systems disclosed in U.S. Patent Application to Ashby, et al, entitled "System and Method for Selective Adjustment of Exercise Apparatus," filed on Feb. 2, 2000 which is incorporated herein in its entirety by reference.

Figure 15:
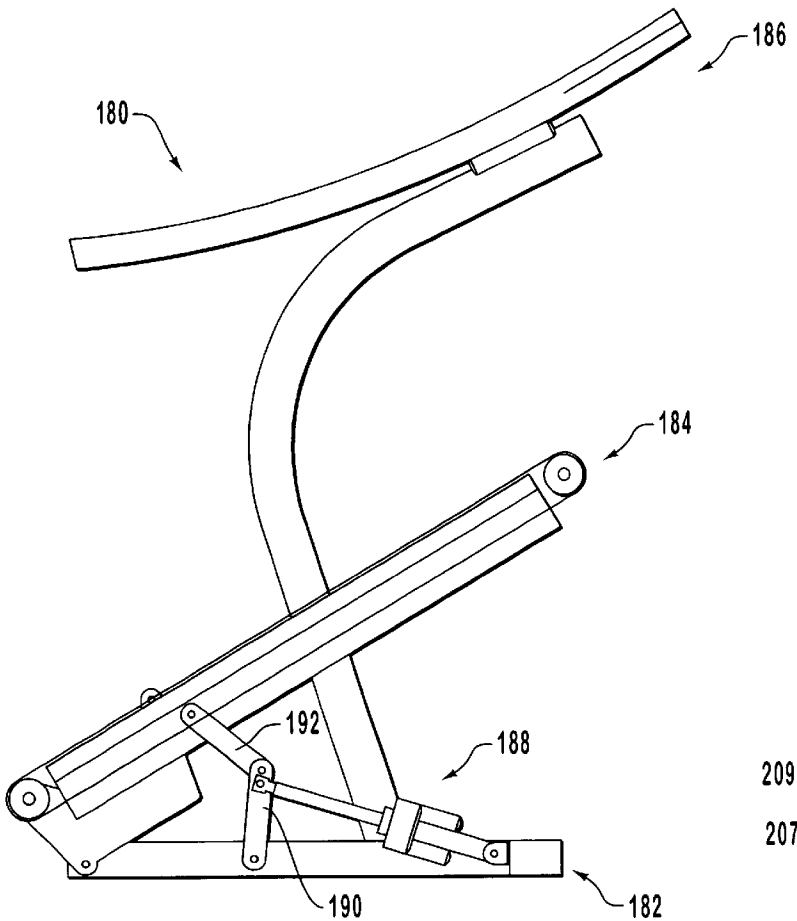
FIG. 15 is a schematic view of an alternate hiking exercise apparatus of the present invention with the treadbase shown in an inclined position.

An alternative hiking exercise apparatus 180 of the present invention is shown in FIG. 15 showing the inclined position of treadbase 184. Apparatus 180 comprises a support base 182, a treadbase 184 movably coupled at a proximal end thereof to support base 182 and handrail assembly 126 coupled to support base 182. The means for selectively moving treadbase 184 shown in FIG. 15 comprises (i) a linear extending assembly in the form of an extension motor 188; and (ii) a pair of pivoting scissor-type members 190, 192. Motor 188 is pivotally coupled to base 182 at one end thereof and pivotally coupled to at least one of the pivoting members (e.g., 190) at an opposing end thereof. Members 190, 192 are pivotally coupled at one end thereof to each other and at opposing ends thereof to support base 182 and treadbase 184, respectively. When extension motor 188 is selectively extended to an extended mode, as shown in FIG. 15, treadbase 184 is inclined. However, upon contraction of motor 188, treadbase is declined.

In one embodiment, a cross beam is coupled between first and second opposing sets of first and second pivotally coupled members, 190, 192 (e.g., by being coupled to members 190) with one set being on each side of apparatus 180. In one embodiment, motor 188 is coupled to the beam, rather than being directly coupled to the sets of pivotally coupled members.

Figure 16:
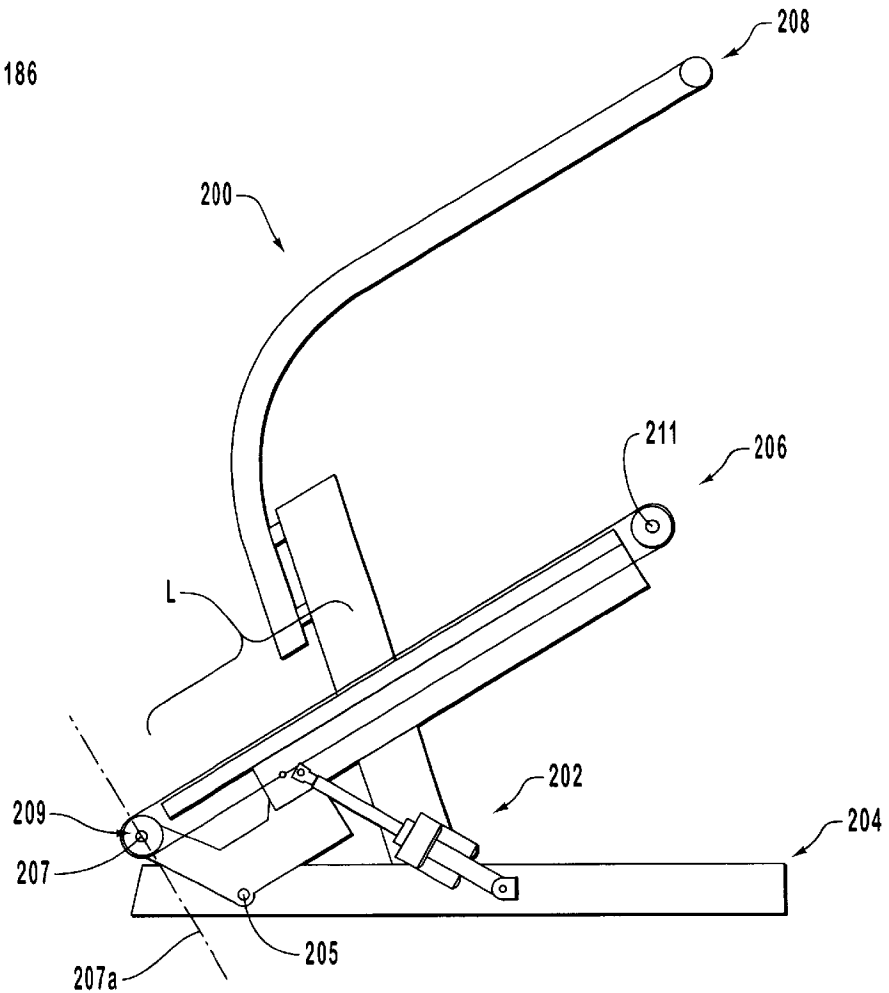
FIG. 16 is a schematic view of an alternate hiking exercise apparatus of the present invention with the treadbase shown in an inclined position.
Figure 17:
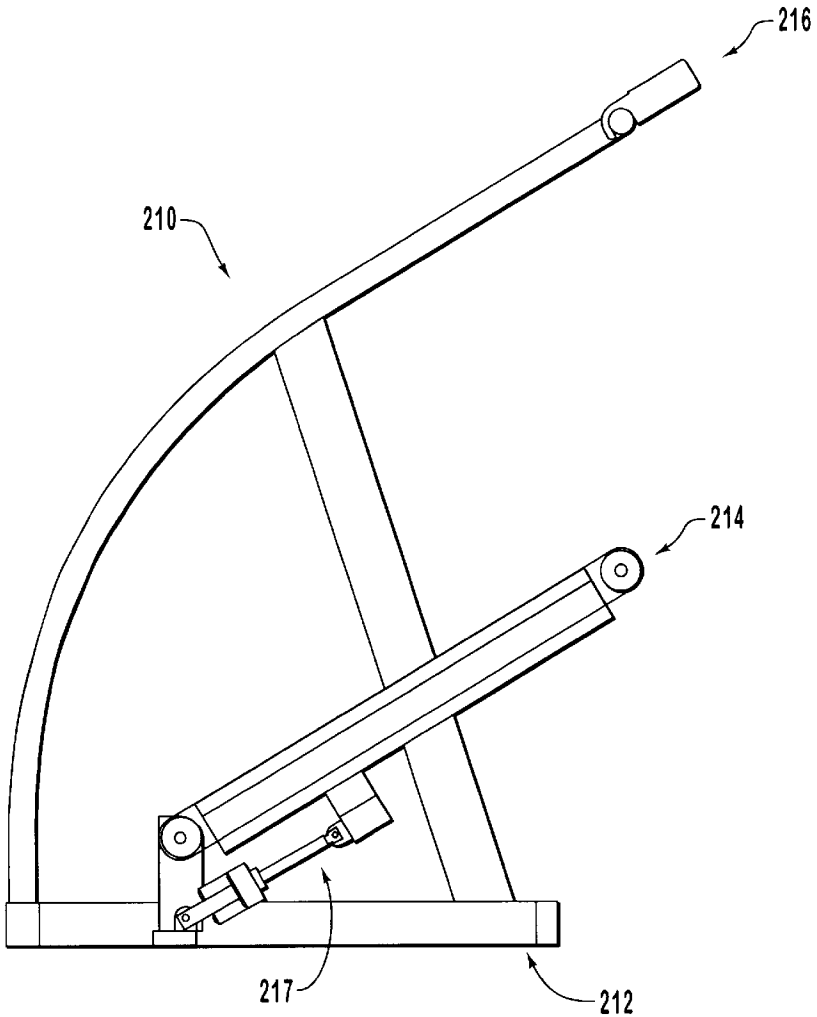
FIG. 17 is a schematic view of an alternate hiking exercise apparatus of the present invention with the treadbase shown in an inclined position.

FIGS. 16 and 17 show additional exercise apparatuses 208, 216 of the prevent invention, respectively. The means for selectively moving treadbase 206 of apparatus 208 comprises a linear extending assembly in the form of an extension motor 202 pivotally coupled between treadbase 206 and support base 204. The means for selectively moving treadbase 214 of apparatus 216 comprises a linear extending assembly in the form of an extension motor 217 pivotally coupled between treadbase 214 and support base 212.

Figure 18:
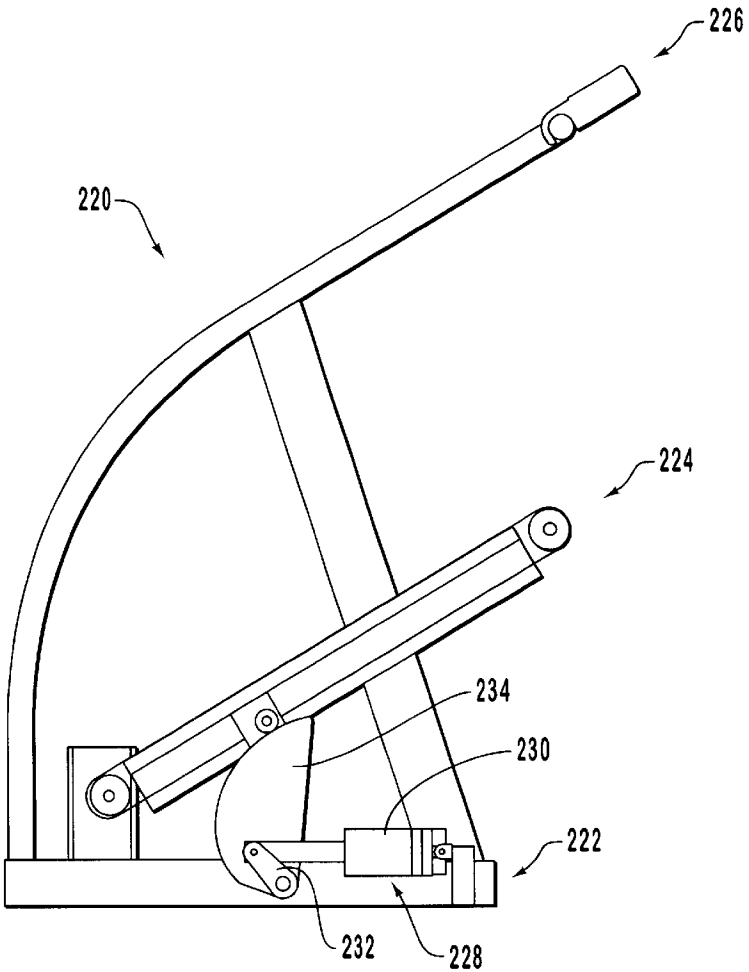
FIG. 18 is a schematic view of an alternate hiking exercise apparatus of the present invention with the treadbase shown in an inclined position.

Another embodiment of an exercise apparatus 220 of the present invention is shown in FIG. 18 comprising a support base 222, a treadbase 224, and a handrail assembly 226 affixed to support base 222. A cam assembly 228 is employed as an example of means for selectively moving treadbase 224. The cam assembly 228 comprises an extension motor 230 pivotally coupled to support base 222 and pivotally coupled to a pivoting crank 232 which is coupled to a cam member 234 which rolls against treadbase 224.

Figure 20:
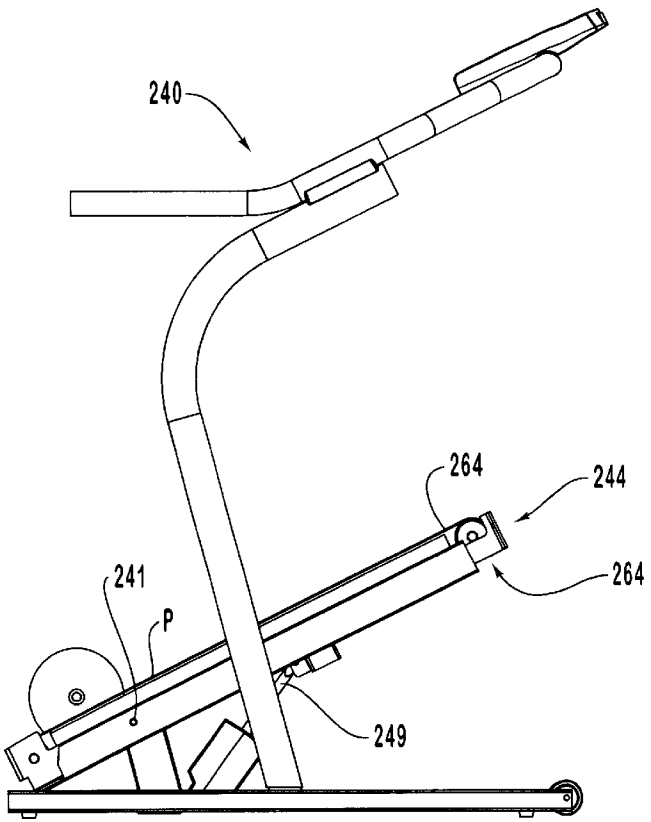
FIG. 20 is a view of exercise apparatus of FIG. 19 with the treadbase thereof in an inclined position.
Figure 19:
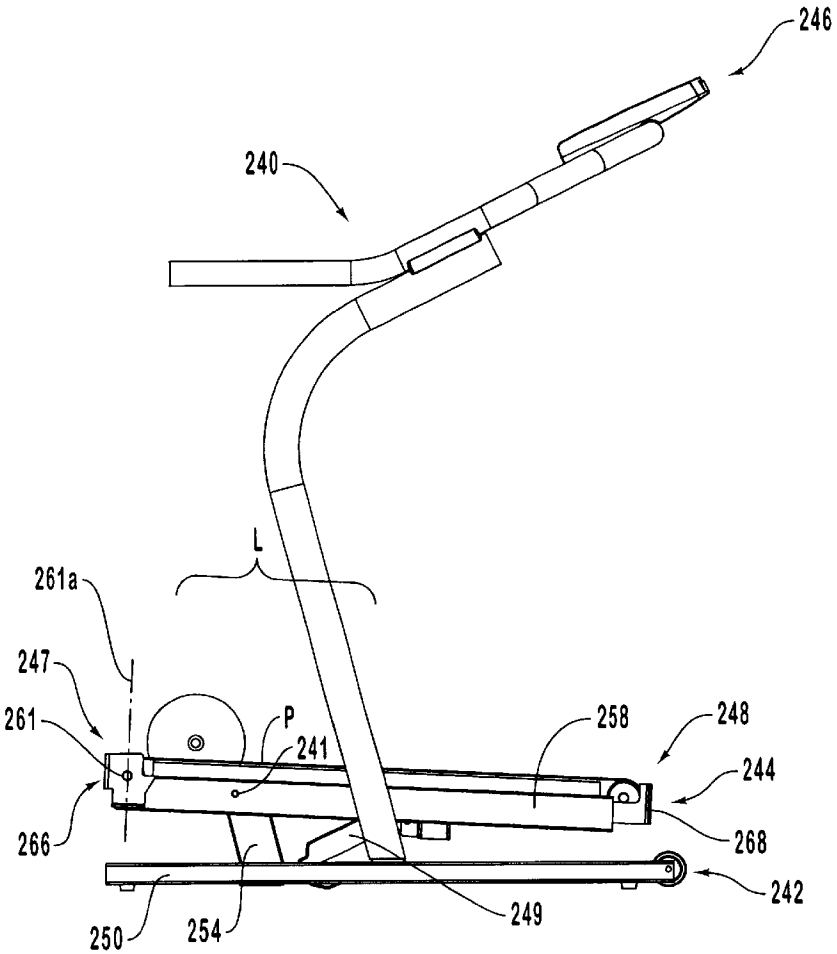
FIG. 19 is a view of an alternate hiking exercise apparatus of the present invention with the treadbase thereof in a declined position.

An alternative hiking exercise apparatus 240 of the present invention is shown in FIG. 19 (showing a declined position of the treadbase) and FIG. 20 (showing an inclined position of the treadbase). Apparatus 240 comprises a support base 242, a treadbase 244 movably coupled to support base 242 and handrail assembly 246 affixed to support base 242. Treadbase 244 has a proximal end 247 and a distal end 248.

The means for selectively moving-treadbase 244 shown in FIGS. 19 and 20 comprises an extension motor 249 or another linear extending assembly. Motor 249 is pivotally coupled to support base 242 at one end thereof and pivotally coupled to treadbase 244 at an opposing end thereof. Upon contraction of motor 249 as shown in FIG. 19, treadbase 244 moves to a declined position. When extension motor 249 is selectively extended to an extended position, as shown in FIG. 20, treadbase 244 is inclined.

Figure 21:
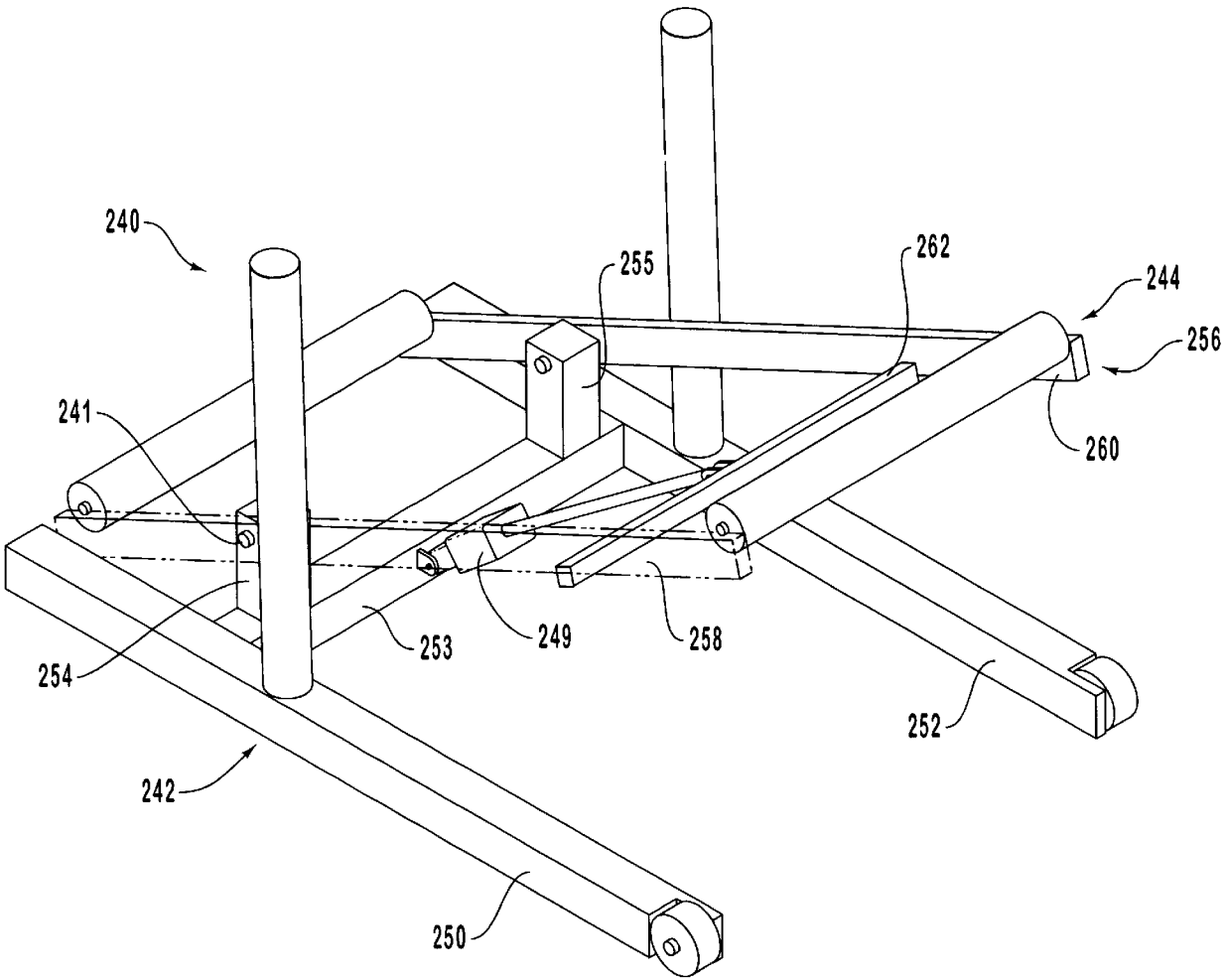
FIG. 21 is a view of certain components of the treadbase and support base of the exercise apparatus of FIGS. 19–20.

Support base 242 and certain components of the frame of treadbase 244 are depicted in FIG. 21. As shown in FIGS. 19–21, support base 242 comprises first and second opposing horizontal side rails 250, 252, connected by a cross member 253 (FIG. 21), and first and second upright members 254, 255 (FIG. 21) extending from respective rails 250, 252. Treadbase 244 of FIGS. 19–21 is pivotally coupled to first and second upright base members 254, 255. In another embodiment, however, a treadbase is pivotally coupled to a support base wherein members such as brackets extend from a frame of the treadbase and are pivotally coupled to the support base, wherein the frame of the treadbase is pivotally coupled directly to rails or a cross member of a support base, or through another pivotal coupling method.

Treadbase 244 comprises a frame 256 having first and second longitudinally extending side rails 258, 260 and an a cross member 262 coupled therebetween beneath belt 264 (FIGS. 19, 20). Extension motor 249 is pivotally coupled at one thereof to cross member 253 of support base 242 and at another end thereof to cross member 262 of treadbase 244.

Treadbase 244 is pivotally coupled at opposing sides thereof to upright members 254, 255 of support base 242, such as through the use of pins extending into members 254, 255 and respective side rails 258, 260. By coupling members 254, 255 to treadbase 244 remotely from the proximal and distal ends 247, 248 thereof motor 249 has increased leverage when attempting to incline or decline treadbase 244.

Furthermore, this remote coupling also enables treadbase 244 to incline or decline significantly without significantly vertically raising or lowering a portion of the ambulating surface of the moving the belt. Thus, a user can use a handrail assembly 246 supporting the user's hands despite the inclination or declination of treadbase 244.

In one embodiment, such as shown in FIG. 19, the phrase "coupled remotely from the end" as used in this specification and the appended claims relates to a coupling which occurs away from either the proximal end 247 or distal end 248 of the treadbase. In one embodiment, the phrase "coupled remotely from the proximal end" as used in this specification and the appended claims relates to a pivotal coupling 241 which occurs at a position located ("L" in FIG. 19) about 10% to about 50% of the length of the treadbase inwardly from a plane 261*a* extending vertically through the center 261 of the proximal roller when treadbase 244 is positioned horizontally. In another embodiment, the pivotal coupling occurs about 15% to about 45% of the length of the treadbase inwardly from plane 261*a* or about 20% to about 40% of the length of the treadbase inwardly from plane 261*a*.

By pivotally coupling fulcrum brackets 254, 255 to this inner portion of treadbase 244 rather than the outer ends 247 or 248, apparatus 240 has improved leverage and fixed handrail assembly 246 is useful during inclination and declination.

One end of motor 249 can also be coupled to the inner portion of treadbase 244, thereby achieving a significant mechanical advantage. The opposing end of motor 249 can also be pivotally coupled to the inner portion of support base 242, i.e., away from the proximal and distal tips of base 242. However, it is also possible to couple motor 249 to a variety of different locations on treadbase 244.

The pivotal coupling of fulcrum brackets 254, 255 and motor 249 to the inner portion of treadbase 244 (remotely from the ends) is useful because treadbase 244 both inclines and declines. This positioning of motor 249 and brackets 254, 255 does not interfere with proximal end 247 as it is lowered or raised. Furthermore, the inner location of motor 249 and brackets 254, 255 does not interfere with the distal end 248 as it is lowered or raised. Thus, proximal and distal ends 247, 248 are able to be moved adjacent to the support surface without interference from a coupling mechanism, as shown in FIG. 20. This provides the optimal amount of inclining and declining while requiring the minimum amount of overall vertical space. Furthermore, because an endless belt is the ambulating surface, rather than a series of steps, paddles or foot supports, there is no requirement for the additional clearance space otherwise required for steps, paddles or supports. This conserves space and enables a user to achieve a significantly inclined workout without requiring the exercise device to be overly tall.

As mentioned, this inner coupling also enables treadbase 244 to incline or decline significantly without significantly vertically raising or lowering a portion of the ambulating surface of moving belt 264. Note the insubstantial difference in vertical height between ambulation point "P", for example, on FIG. 19 and ambulation point "P" on FIG. 20. A user stepping at ambulation point "P" experiences a substantial change in incline from FIG. 19 to FIG. 20, but does not raise substantially vertically with respect to handrail assembly 246. Thus, fixed handrail assembly 246 is useful in an inclined (FIG. 20), declined (FIG. 19) or neutral position. This ability to dramatically incline without requiring significant vertical raising is also more gentle on the incline motor and does not cause as much strain.

Naturally, proximal and distal ends 247, 248 raise and lower significantly during inclination and declination, respectively. However, more central ambulation points, such as those points "P" adjacent the pivot point of treadbase 244 do not dramatically change in vertical height. Thus, particularly when stepping at the more central ambulation points, the user can use the fixed handrail assembly 246 in an inclined, declined, and flat mode.

The remote coupling of treadbase 244 is useful when treadbase inclines such as in excess of about 15% grade and is particularly useful at high inclines, such as when treadbase 244 inclines in excess of about 25% grade. At these grades, inclination can result in significant vertical movement if a treadbase is pivotally coupled at a proximal or distal end. The treadbase 244 of the present invention, however, does not take up as much vertical space and central ambulation points are not raised significantly with respect to a handrail assembly. Thus, the exerciser can still use the handrail assembly even though the treadbase has inclined substantially.

As another advantage of apparatus 240, the frame of treadbase 244 comprises a cross member 262 (FIG. 21) extending between frame rails 258, 260 underneath the belt 264 (FIG. 20). Cross member is pivotally coupled to motor 249. This positioning of cross member 262 enables convenient coupling of motor 249 to an inner portion of treadbase 244 remotely from the proximal end.

FIG. 16 also demonstrates another example of a treadbase 206 pivotally coupled to a support base 204 remotely from the proximal end of the treadbase 206. Note that the pivotal coupling 205 of treadbase 206 to support base 204 occurs at a position located ("L" in FIG. 16) about 10% to about 50% of the length of the treadbase inwardly from plane 207*a*.

By way of example, in one embodiment, treadbase 206 has a length of about 36 inches from the center 207 of the proximal roller 209 to the center 211 of the distal roller. In this embodiment, pivot point 205 may be located about 3.6 to about 18 inches (i.e., about 10% to about 50% of the treadbase) inwardly from plane 207*a* extending vertically through proximal roller center 207 when treadbase 206 is positioned horizontally, for example.

Figure 22:
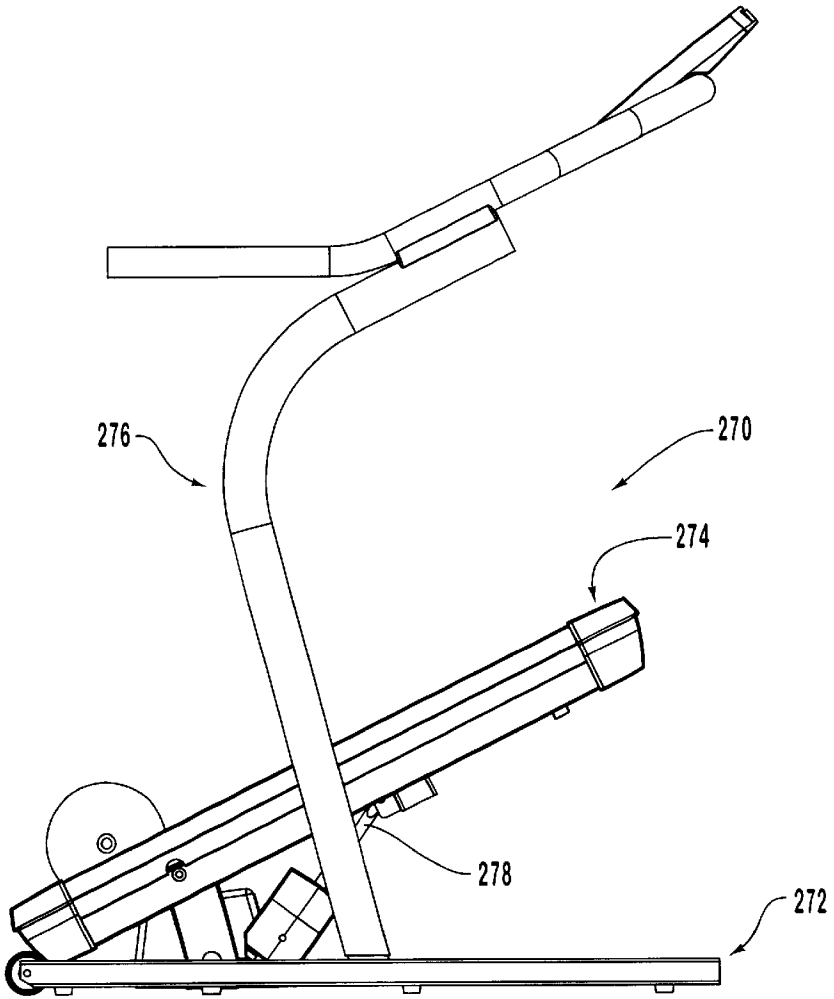
FIG. 22 is a view of an alternate hiking exercise apparatus of the present invention with the treadbase thereof in an inclined position.
Figure 23:
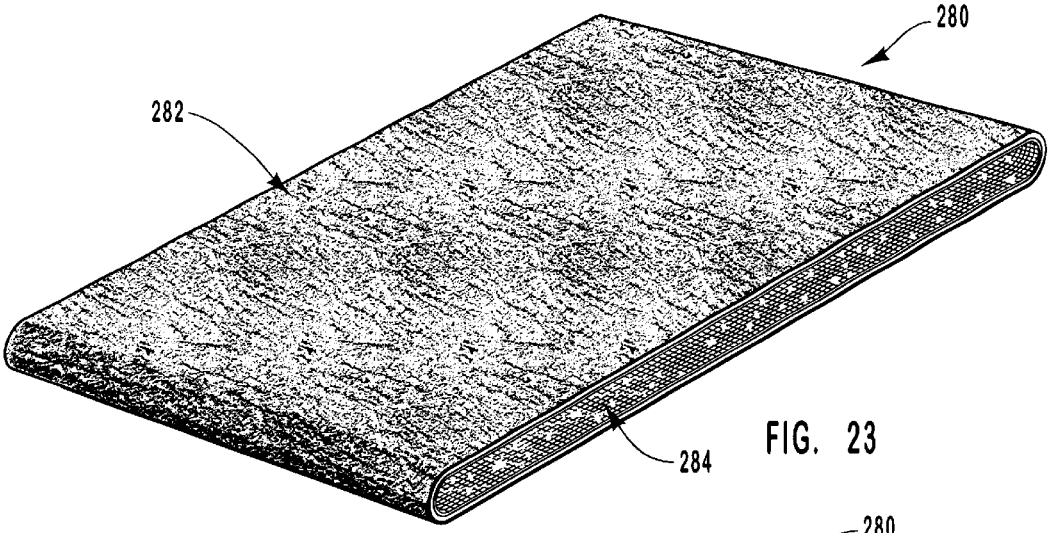
FIG. 23 is a perspective view of an example of an endless belt of the present invention having a rough, uneven upper surface.
Figure 24:
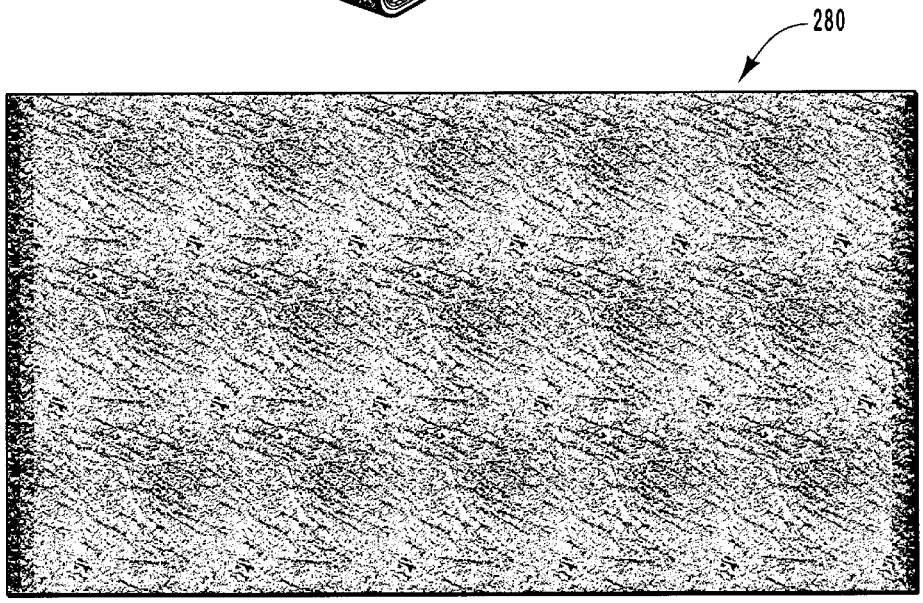
FIG. 24 is a front view of the endless belt of FIG. 23, the rear view being identical.
Figure 25:
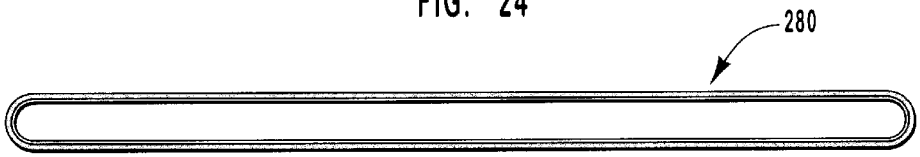
FIG. 25 is a side view of the endless belt of FIG. 23, the opposite side view being identical.
Figure 26:
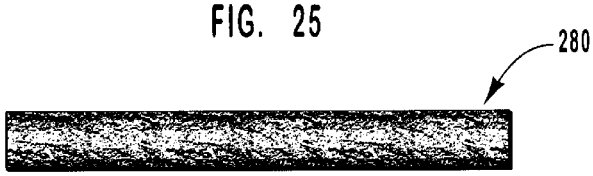
FIG. 26 is a top view of the endless belt of FIG. 23, the bottom view being identical.

FIG. 22 is a view of an alternate hiking exercise apparatus 270 of the present invention having a support base 272 and a treadbase 274 pivotally coupled to the support base 272 remotely from the proximal end of the treadbase. A handrail assembly 276 is affixed to the treadbase. An extension motor 278 is pivotally coupled to support base 272 and treadbase 274.

In one embodiment of a hiking apparatus of the present invention, a treadbase such as treadbase 274 (FIG. 22), 244 (FIGS. 19–21), or 206 (FIG. 16) is pivotally coupled remotely from the proximal end thereof to a support base and the apparatus further comprises a handrail assembly, (such as assembly 16 shown in FIG. 1 or assembly 106 of FIG. 7) which adjusts automatically throughout the range of motion of the treadbase.

A handrail assembly of the present invention may be a single handrail (i.e., held by one hand only), first and second handrails coupled to each other, a single handrail with a motor attached thereto, first and second handrails each with a motor coupled thereto, a two-part assembly, a telescoping assembly, a solid handrail, a tubular handrail, or a variety of other handrails, each of which are also examples of means for supporting at least one arm of a user ambulating on the treadbase. The frames of the apparatuses herein may includes wheels thereon for moving the apparatuses, such as on the support bases.

Figure 5:
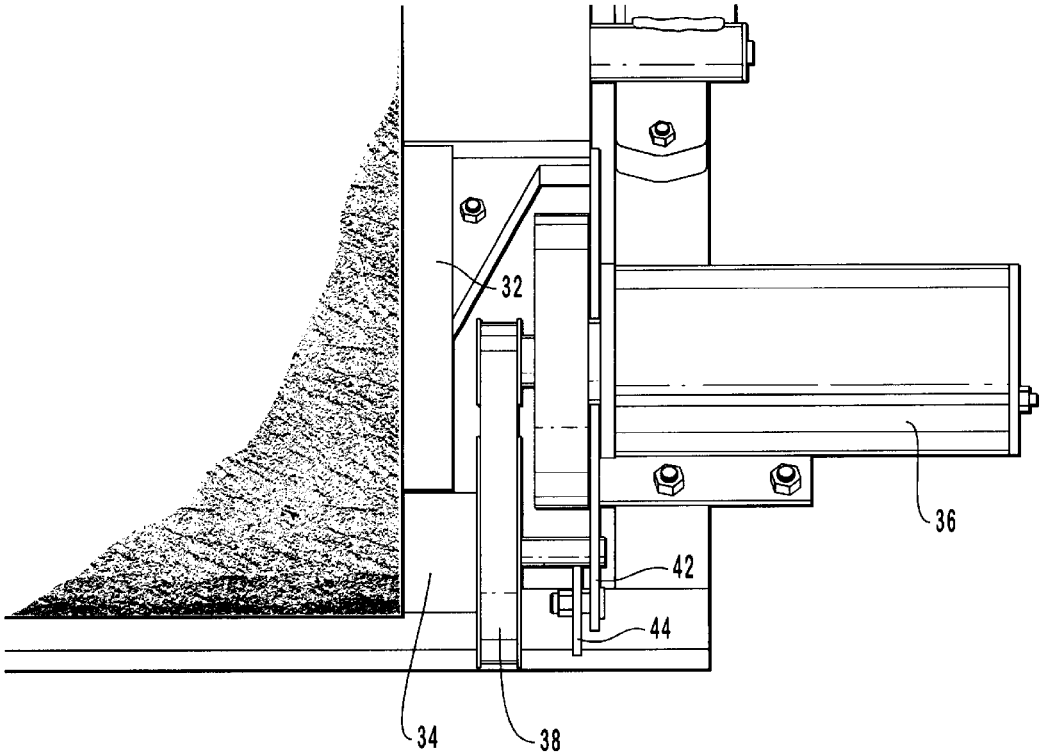
FIG. 5 is a cutaway view of a proximal corner of the exercise apparatus of FIG. 1 demonstrating a plate coupling the treadbase, including its motor, to the support base.

A variety of different treadmill belts may be employed in the present invention. In one embodiment, the treadmill belt has a design simulating the kind of terrain experienced during hiking, such as a design simulating the surface of shale rock, for example. One embodiment of a treadmill belt 280 featuring a rough, uneven rock-like upper surface 282 is shown in FIGS. 23–26, for example. This design renders both the ornamental design and appearance of a rocky terrain, which has an appealing visual appearance for a user and also allows the user to ambulate on a surface simulating the kind of rocky terrain experienced during hiking. In one embodiment, upper surface 282 is comprised of neoprene or another material which can be formed to simulate a rough, rocky appearance. This material can be mounted on a lower surface 284 comprising a mesh material, for example. Additional examples of such rough, uneven, rocklike upper surfaces on endless belts are shown in FIGS. 11–14 on treadbase 144 and in the corner portion of treadbase 14 of FIG. 5.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A hiking exercise apparatus comprising:

a support base;

a treadbase having a first roller adjacent a rear proximal end, a second roller adjacent a front distal end, and a center located halfway between the proximal and distal ends, the first roller having a first axis of rotation and the second roller having a second axis of rotation, the treadbase being pivotally coupled to the support base at a point located distally from the first axis and proximally from the center of the treadbase such that an inclination of the treadbase can be selectively varied between two or more operational positions, the treadbase having an endless moving belt, an upper portion of which moves from the front, distal end towards the rear, proximal end.

2. A hiking apparatus as recited in claim 1, wherein the treadbase selectively inclines to an angle greater than about 25% grade.

3. A hiking exercise apparatus as recited in claim 1, wherein the width of the endless, moving belt of the hiking apparatus is at least 50% the size of the length of the belt.

4. A hiking exercise apparatus as recited in claim 1, wherein the width of the moving belt is about 18 inches or more and the length is about 40 inches or less.

5. A hiking exercise apparatus as recited in claim 1, wherein the treadbase selectively declines.

6. A hiking exercise apparatus as recited in claim 1, wherein the pivotal coupling of the treadbase to the support base occurs at a position located about 10% to about 50% of the length of the treadbase inwardly from a plane extending vertically through the center of a proximal roller of the treadbase when the treadbase is positioned horizontally.

7. A hiking exercise apparatus as recited in claim 1, wherein the treadbase of the hiking apparatus selectively inclines and selectively declines, and wherein the treadbase inclines to an angle greater than about 25% grade.

8. A selectively inclining hiking apparatus as recited in claim 7, further comprising braking means for slowing the speed of the treadbase.

9. A hiking exercise apparatus as recited in claim 1, wherein the incline of the treadbase changes substantially without moving an ambulation point, on which a user ambulates, substantially in a vertical direction.

10. A hiking exercise apparatus as recited in claim 1, wherein an endless belt of the apparatus has a rough, uneven upper surface.

11. A selectively inclining hiking exercise apparatus as recited in claim 1, wherein the support base comprises:

a substantially horizontal portion configured to rest upon a support surface; and an upright portion configured to be pivotally coupled to the treadbase, the upright portion being pivotally coupled to the inner portion of the treadbase.

12. A hiking exercise apparatus as recited in claim 1, wherein the treadbase selectively inclines and selectively declines.

13. A hiking apparatus as recited in claim 1, wherein a cross beam of a treadbase frame is positioned below an endless belt and wherein means for selectively moving the treadbase is pivotally coupled at one end thereof to the cross beam.

14. A selectively inclining and declining hiking exercise apparatus which supports a user ambulating thereon, the selectively inclining hiking exercise apparatus comprising:

a support base; and a treadbase having a proximal end, a distal end, and an inner portion therebetween, the treadbase selectively inclining and selectively declining with respect to a neutral position which is substantially parallel to a support surface, the treadbase being pivotally coupled at the inner portion thereof to the support base, wherein the treadbase is selectively moved into a position having a grade of about—10% with respect to the neutral position to about 100% with respect to the neutral position, and wherein the treadbase comprises:

(a) a treadbase frame;

(b) first and second rollers; on opposing proximal and distal ends of the frame, respectively; and (c) an endless belt movably mounted on the first and second rollers; and means for selectively moving the treadbase, the means for selectively moving the treadbase being coupled to the support base and to the inner portion of the treadbase, the treadbase and the means for selectively moving the treadbase being coupled to the support base such that the proximal and distal ends of the treadbase can be selectively positioned adjacent the support surface in inclined and declined positions, respectively.

15. A hiking exercise apparatus comprising:

a substantially horizontal support base;

a treadbase having a proximal end, a distal end, and center located halfway between the proximal and distal ends, the treadbase being pivotally coupled to the support base; and means pivotally coupled to the substantially horizontal support base and the treadbase for supporting at least one arm of a user ambulating on the treadbase.

16. A selectively inclining hiking exercise apparatus as recited in claim 15, wherein the means for supporting at least one arm of a user comprises a handrail assembly.

17. A hiking exercise apparatus as recited in claim 16, wherein the handrail assembly inclines at a different rate than that of the distal end of the treadbase.

18. A selectively inclining hiking exercise apparatus as recited in claim 16, wherein the handrail assembly comprises a first member pivotally coupled to the base and a second member pivotally coupled to the treadbase, the first and second members movably coupled to each other.

19. A selectively inclining hiking exercise apparatus as recited in claim 18, wherein the first and second members are members of a two-part telescoping assembly which selectively extends and contracts.

20. A selectively inclining hiking exercise apparatus as recited in claim 19, wherein the handrail assembly further comprises a motor configured to selectively move the telescoping assembly, wherein movement of the telescoping assembly moves the treadbase.

21. A selectively inclining hiking exercise apparatus as recited in claim 16, wherein movement of the handrail assembly results in movement of the treadbase.

22. An apparatus as recited in claim 16, wherein the handrail assembly is coupled to the treadbase such that the position of the handrail assembly adjusts automatically throughout the range of motion of the treadbase.

23. A selectively inclining hiking exercise apparatus as recited in claim 15, wherein an inner portion of the treadbase is pivotally coupled to the support base such that the treadbase is coupled to the support base remotely from the proximal and distal ends of the treadbase.

24. A selectively inclining hiking apparatus as recited in claim 15, further comprising braking means for slowing the speed of the treadbase.

25. An apparatus as recited in claim 15, wherein the means coupled to the support base and the treadbase for supporting at least one arm of a user ambulating on the treadbase comprises: means for selectively moving the treadbase.

26. An apparatus as recited in claim 15, further comprising: (i) a linear extending assembly; and (ii) a pivoting lever coupled to the linear extending assembly.

27. An apparatus as recited in claim 26, wherein the lever is pivotally coupled at a lower end thereof to the support base and has at an upper end thereof a rotating wheel which rolls against the treadbase.

28. A selectively inclining hiking exercise apparatus as recited in claim 15, wherein movement of the treadbase results in movement of the means coupled to the support base and the treadbase for supporting at least one arm of a user ambulating on the treadbase.

29. A hiking exercise apparatus comprising:

a substantially horizontal support base;

a treadbase having a proximal end, a distal end, and a center located halfway between the proximal and distal ends, the treadbase being pivotally coupled to the support base, the treadbase selectively inclining; and a handrail assembly pivotally coupled to the substantially horizontal support base and the treadbase such that the handrail assembly moves in order to compensate for the movement of the treadbase.

30. An apparatus as recited in claim 29, wherein the handrail assembly is coupled to the treadbase such that the position of the handrail assembly adjusts automatically throughout the range of motion of the treadbase.

31. An apparatus as recited in claim 29, wherein the treadbase selectively inclines and selectively declines with respect to a neutral position thereof which is substantially parallel to a support surface, the handrail assembly selectively inclining and declining at a different rate than that of the treadbase.

32. An apparatus as recited in claim 29, wherein a support member of the handrail assembly remains substantially horizontal despite movement of the treadbase and the handrail assembly as the treadbase moves between an inclined position and a declined position.

33. A hiking exercise apparatus as recited in claim 29, wherein the handrail assembly comprises:

an upright member affixed to the support base;

a substantially horizontal member pivotally coupled to the upright member affixed to the support base; and a pivoting member pivotally coupled at one end to the substantially horizontal member and pivotally coupled at an opposing end to the treadbase.

34. A hiking apparatus as recited in claim 29, wherein the treadbase inclines to an angle greater than about 25% grade.

35. A selectively inclining and declining hiking exercise apparatus which supports a user ambulating thereon, the selectively inclining and declining hiking exercise apparatus comprising:

a support base;

a treadbase having a proximal end, a distal end, and an inner portion therebetween, the treadbase being pivotally coupled to the support base, the treadbase selectively inclining and selectively declining with respect to a neutral position thereof which is substantially parallel to a support surface, wherein the treadbase is selectively moved into a position having a grade of about −5% with respect to the neutral position to about 60% with respect to the neutral position;

means pivotally coupled to the support base and the treadbase for selectively moving the treadbase; and means pivotally coupled to the support base and the treadbase for supporting at least one arm of a user ambulating on the treadbase, such that the position of the means for supporting at least one arm of a user adjusts automatically throughout the range of motion of the treadbase.

36. An apparatus as recited in claim 35, wherein the means pivotally coupled to the support base and the treadbase for selectively moving the treadbase is part of a handrail assembly.

37. An apparatus as recited in claim 35, wherein the means pivotally coupled to the support base and the treadbase for selectively moving the treadbase is separate from a handrail assembly.

38. A hiking exercise apparatus comprising:

a support base;

a treadbase having a first roller adjacent a rear proximal end, a second roller adjacent a front distal end, and a center located halfway between the proximal and distal ends, the first roller having a first axis of rotation and the second roller having a second axis of rotation, the treadbase selectively inclining with respect to the support base allowing a user to exercise at varying grades of inclination, the treadbase being pivotally coupled to the support base at a position located distally from the first axis and proximally from the center, the treadbase having an endless moving belt which is driven by a motor, wherein an upper portion of said belt moves from the front, distal end towards the rear, proximal end.

39. The selectively inclining hiking exercise apparatus of claim 38, wherein the position of coupling improves leverage of the treadbase.

40. The selectively inclining hiking exercise apparatus of claim 38, wherein the position of coupling enables the treadbase to incline or decline without vertically raising the ambulating surface of a moving belt significantly with respect to a handrail assembly.

* * * * *

UNITED STATES PATENT AND TRADEMARK OFFICE

CERTIFICATE OF CORRECTION

PATENT NO. : 6,761,667 B1
APPLICATION NO. : 09/496569
DATED : July 13, 2004
INVENTOR(S) : Cutler et al.

It is certified that error appears in the above-identified patent and that said Letters Patent is hereby corrected as shown below:

Column 4
Line 41, before "exercise" insert --the--

Column 7
Line 37, after "apparatus" change "such as a" to --such as--
Line 61, after "handrail assembly" insert --16--

Column 8
Line 40, after "extends into upper" change "portion." to --portion 54.--

Column 9
Line 5, after "support base" change "20" to --12--

Column 12
Line 18, after "assembly" change "126" to --186--
Line 39, before "invention" change "prevent" to --present--

Column 13
Line 22, after "258, 260 and" remove [an]

Column 14
Line 58, after "Cross member" insert --262--

Signed and Sealed this

Eleventh Day of July, 2006

JON W. DUDAS
*Director of the United States Patent and Trademark Office*